US010286288B1

(12) United States Patent
Gross

(10) Patent No.: US 10,286,288 B1
(45) Date of Patent: May 14, 2019

(54) TORSIONAL STABILIZER FOR SKIS

(71) Applicant: Alpine Radius Control Technologies, LLC, McKinney, TX (US)

(72) Inventor: Steven Kendall Gross, McKinney, TX (US)

(73) Assignee: Alpine Radius Control Technologies, LLC, McKinney, TX (US)

( * ) Notice: Subject to any disclaimer, the term of this patent is extended or adjusted under 35 U.S.C. 154(b) by 0 days.

(21) Appl. No.: 15/389,483

(22) Filed: Dec. 23, 2016

Related U.S. Application Data

(60) Provisional application No. 62/387,653, filed on Dec. 29, 2015.

(51) Int. Cl.
*A63C 5/07* (2006.01)

(52) U.S. Cl.
CPC ..... *A63C 5/07* (2013.01)

(58) Field of Classification Search
CPC ..... A63C 5/07; A63C 5/075; A63C 9/003; A63C 9/007; A63C 9/00
USPC ..... 280/602
See application file for complete search history.

(56) References Cited

U.S. PATENT DOCUMENTS 3,300,226 A * 1/1967 Reed, Jr. ..... A63C 5/07 280/602
4,139,214 A * 2/1979 Meyer ..... A63C 9/00 267/160
4,199,169 A * 4/1980 Guenzel ..... A63C 5/06 280/602
4,592,567 A * 6/1986 Sartor ..... A63C 5/07 280/602
4,696,487 A * 9/1987 Girard ..... A63C 5/07 280/602
5,269,555 A * 12/1993 Ruffinengo ..... A63C 5/07 280/602
5,280,942 A * 1/1994 Ruffinengo ..... A63C 9/00 280/602
5,360,220 A * 11/1994 Simmons ..... B62B 17/02 280/28
5,393,086 A * 2/1995 Le Masson ..... A63C 5/07 280/602
5,464,242 A * 11/1995 Commier ..... A63C 5/07 280/602
5,465,994 A * 11/1995 Commier ..... A63C 5/075 280/602

(Continued)

FOREIGN PATENT DOCUMENTS

WO PCT/GR2003/000033 A1 2/2004

*Primary Examiner* — Katy M Ebner
(74) *Attorney, Agent, or Firm* — Hancock Hughey LLP

(57) ABSTRACT

A torsional stabilizer increases the torsional rigidity of skis without influencing the ski's flexural characteristics. There are numerous embodiments of the invention disclosed for preventing torsional rotation of a ski about its longitudinal axis while at the same time having little to no impact on the flexing characteristics of the ski. The innovations defined by the invention may be delivered through exoskeletal means (via mechanisms and linkages attached directly to snow skis) or through dynamic structural members or mechanisms integrated within the ski design itself. In all cases, the stabilizers according to the invention effectively reduce the ski's tendency to twist about its longitudinal axis when subjected to the turning forces created during the sport of alpine skiing.

16 Claims, 21 Drawing Sheets

(56) References Cited

U.S. PATENT DOCUMENTS 5,470,094 A * 11/1995 Commier ..... A63C 5/075 280/602
5,513,872 A * 5/1996 Arduin ..... A63C 5/07 280/602
5,597,170 A * 1/1997 Le Masson ..... A63C 5/07 280/602
5,779,257 A * 7/1998 Bonvallet ..... A63C 5/075 280/602
5,785,342 A * 7/1998 Bronson ..... A63C 5/075 280/602
5,806,875 A * 9/1998 Bonvallet ..... A63C 5/075 280/602
5,924,717 A * 7/1999 Janisch ..... A63C 5/07 280/602
5,927,743 A * 7/1999 Mantel ..... A63C 5/07 280/602
6,729,640 B1 * 5/2004 Sedlmair ..... A63C 5/07 280/602
7,159,891 B1 * 1/2007 Niggemann ..... A63C 9/003 280/607
7,708,302 B2 * 5/2010 Wilson ..... A63C 5/03 280/11.14
8,794,658 B2 * 8/2014 Wilson ..... A63C 5/0405 280/602
2004/0084879 A1 * 5/2004 Wilson ..... A63C 5/0485 280/608
2005/0104328 A1 * 5/2005 Emig ..... A63C 5/075 280/602
2005/0206128 A1 * 9/2005 Gignoux ..... A63C 5/07 280/602
2006/0145451 A1 * 7/2006 Wilson ..... A63C 5/0405 280/602
2006/0226613 A1 * 10/2006 Wilson ..... A63C 5/03 280/14.22
2007/0182129 A1 * 8/2007 Wilson ..... A63C 5/0405 280/602
2010/0237588 A1 * 9/2010 Krause ..... A63C 5/07 280/608
2016/0008697 A1 * 1/2016 Puget ..... A63C 5/075 280/602
2016/0051884 A1 * 2/2016 Yi ..... A63C 5/02 280/607
2016/0051885 A1 * 2/2016 Yi ..... A63C 5/02 280/809
2017/0080324 A1 * 3/2017 Moenne-Loccoz .... A63C 5/075

* cited by examiner

TORSIONAL STABILIZER FOR SKIS

TECHNICAL FIELD

The present invention relates to skis for use in the sport of alpine skiing, and more particularly, to apparatus for influencing the mechanical and performance characteristics of alpine skis, and even more specifically, to apparatus for torsionally stabilizing alpine skis to prevent skis from skidding sideways during carved turns.

BACKGROUND

In the sport of alpine skiing, performance is often a measure of the skier's ability to maintain precisely carved turns. Carved turns track a smooth and continuous path that is at all times parallel to that portion of the ski located beneath the ski boot. The alternative to a precisely carved turn is a skidded turn. Skidding occurs when the skier rotates, points or directs the skitoward the inside of the direction the skier is actually travelling. When this occurs the ski is no longer tracking along its length but is skidding sideways. This sideways skidding of the ski results in a loss of speed. For this reason, precise carving of turn is critical to achieve good results in the sport of alpine ski racing. Precisely carved turns enable the skier to maintain the fastest line or path through a race course. Additionally, a carved turn prevents the skier from being forced to deal with erratic lateral motions and forces that are created once a ski begins to skid sideways.

When referring to alpine ski construction, "sidecut" refers to the narrowing of the waist of the ski, near the mid length of the ski. In the early days of alpine ski racing, skis possessed a very slight or minimal sidecut. However, in the 1980s ski designers began to understand that increased sidecut allowed more precise ability to carve the ski; the slightly wider tip and tail of the ski combine with the narrow mid-section waist to form an hourglass shape to the ski. This hourglass shape allows the ski to de-camber (i.e., bend into an arc) when the ski is placed on edge and turning forces are applied. Throughout the early era of alpine ski racing, the most successful competitors were those able to bend or de-camber the skis into an arc that precisely matched the radius of curvature of the path the skier hoped to travel. By bending the ski into to this arc and maintaining the ski on edge, accomplished ski racers travelled a precisely carved arc with minimal or no lateral skidding. Just as importantly, by carving precise turns with the skis de-cambered the skier is actually able to laterally accelerate the ski in the turn. In contrast, when a skier is unable to de-camber a ski in a turn and the ski skids sideways, the speed of the skier decreases and control is decreased due to diminishment in the performance characteristics of the ski. Clearly, in the sport of alpine ski racing, speed and control are of utmost importance and therefore, skidded turns are undesirable.

The sport of alpine skiing experienced a revolution with the introduction of the shaped ski. Shaped skis have considerably increased sidecut. This is accomplished by increasing the width of the ski at the tip and tail while reducing or maintaining a narrow ski width at the waist. The shaped ski provides a sidecut that forms a reduced radius of curvature versus traditional alpine skis. This development allowed skiers of many ability levels to begin to experience precisely carved turns, even without appreciably de-cambering the skis. Simply by rolling or placing the skis over onto the edges, the average skier began to experience the stability and precision of a carved turn, free from lateral skidding.

By softening or reducing the flexural stiffness of alpine skis, skiers of moderate or average ability began to experience carved turns as they learned to bend the skis into arcs rivaling those of professional ski racers. The increased sidecut of the shaped ski allowed flexurally softer skis to de-camber and form tighter radius turns as moderate to advanced skiers learned to place the ski on edge and load it with turning forces. The shaped ski revolution brought increased lateral acceleration (associated with tighter radius turns) and precise tracking of the turns along the ski's length, free of lateral skidding, to the masses of the skiing public. The narrow-waisted, wide-in-tip-and tail shaped skis, in combination with reduced flexural stiffness transformed the sport of alpine skiing allowing skiers of even moderate ability to experience the acceleration and stability of the precisely carved turn.

One drawback of this technological revolution involves a balance between the ski's torsional rigidity versus flexural stiffness. Flexural stiffness is a measure of the force required to bend the ski upward (at the tip or tail) some given distance along the longitudinal axis defined by the ski. On the other hand, torsional rigidity is a measure of the amount of torque required to twist or warp the ski some given angular rotation about the ski's longitudinal axis. The softer flex and increased sidecut of modern skis effectively reduce the torsional rigidity of the ski. Reduced torsional rigidity allows the ski to twist about its longitudinal axis as the skier places the ski on edge and loads it into the turn. This twisting of the ski effectively reduces the amount of edge angle at the ski tip (or tail) versus the amount of edge angle at the ski mid-length (beneath the ski boot sole). Depending upon snow conditions, the edge angle, that is, the amount that the ski is rotated about the long axis relative to the surface of the snow, may determine whether a ski continues to carve along its length versus breaking loose into a lateral skid. For this reason, torsional rigidity is a very important and desirable characteristic for a high performance ski.

Unfortunately, both the increased sidecut and softer flexural characteristics of modern shaped skis compromise or reduce torsional rigidity. Ski manufacturers strive to reduce this inherent trade-off by employing advanced materials and creative composite lay-up techniques. Nonetheless, softer flexing skis with increased sidecut offer inherently reduced torsional rigidity. Reduced edge angles at the tip and tail resulting from this lesser torsional rigidity compromise the ski's ability to hold an arc when highest levels of performance are called for.

There is a need therefore for shaped skis that have soft flexural characteristics while maintaining torsional rigidity.

Freely flexing torsional stiffener techniques as described within this specification eliminate the tradeoffs between softer flex and increased sidecut versus torsional rigidity. The technologies, techniques and methods described within this specification enable a very soft flexing ski to exhibit near perfect torsional rigidity. Perfectly rigid torsion would be a ski that encounters no twisting about its length, regardless of the turning forces exerted in the ski. These innovations allow modern skis to deliver almost constant edge angle throughout the length of the ski, from boot-sole region to the tip and from boot-sole region to the tail. These advances deliver a new level of ultimate performance to the modem, easy carving soft flexing and increased sidecut skis, as well as skis for more advanced skiers and even skis build specifically for the performance required during racing.

The torsional stiffener of the present invention comprises apparatus for increasing the torsional rigidity of skis without influencing the ski's flexural characteristics. There are numerous embodiments of the invention disclosed for preventing torsional rotation of a ski about its longitudinal axis while at the same time having little to no impact on the flexing characteristics of the ski. The innovations defined by the invention may be delivered through exoskeletal means (via mechanisms and linkages attached directly to snow skis) or through dynamic structural members or mechanisms integrated within the ski design itself. In all cases, these techniques effectively reduce the ski's tendency or proclivity to twist about its longitudinal axis when subjected to the turning forces created during the sport of alpine skiing. The technological advancements defined by the invention minimize the amount or extent to which a ski's edge angle deteriorates or degrades along the ski length when subjected to extreme loading created by high performance skiing.

BRIEF DESCRIPTION OF THE DRAWINGS

The invention will be better understood and its numerous objects and advantages will be apparent by reference to the following detailed description of the invention when taken in conjunction with the following drawings.

FIG. 6A is a perspective view of a front axle pivot block.

FIG. 6B is a top view of the pivot block showing the mounting and axle bores in phantom lines.

FIG. 6C is a side view of the pivot block shown in FIG. 6B.

FIG. 6D is a bottom view of the pivot block shown in FIG. 6C.

FIG. 6E is an end view of the pivot block shown in FIG. 6D.

FIG. 7A is a perspective view of the front axle pivot plate.

FIG. 7B is a top plan view of the pivot plate shown in FIG. 7A.

FIG. 7C is a side elevation view of the pivot plate of FIG. 7A.

FIG. 7D is a front elevation view of the pivot plate of FIG. 7A.

FIG. 8A is a perspective view of a front axle pivot clamp.

FIG. 8B is a top plan view of the pivot clamp shown in FIG. 8A.

FIG. 8C is an end elevation view of the pivot clamp of FIG. 8A.

FIG. 8D is a side elevation view of the pivot clamp of FIG. 8A.

FIG. 10A is a side elevation view of a ski on which a torsional stabilizer has been mounted. In FIG. 10A the base of the ski is flat against a horizontal surface as the ski would be when the ski is not turning.

FIG. 10B is a side elevation view of the ski of FIG. 10A except in FIG. 10B the ski tip is bending upwardly, away from the horizontal surface, and the ski is de-cambering as it would during a carved turn.

FIG. 10C is a side elevation view as in FIG. 10B except the ski tip has been forced upwardly to an even greater extent than shown in FIG. 10B, with the ski de-cambered to a greater extent as it would during a carved turn.

FIGS. 12 through 20 are a series of drawings of an on-off locking mechanism for selectively engaging and disengaging the torsional stabilizer according to the present invention. Specifically, FIG. 12 is a side elevation and partially cross sectional view of the on-off mechanism according to the invention, shown in isolation; in FIG. 20 the mechanism is shown in the on or locked position.

FIG. 19 is a perspective view of a torsional stabilizer tube according to the present invention in which the on-off mechanism is installed.

FIG. 20 is a side elevation and partially cross sectional view of the on-off mechanism according to the invention, shown in isolation; in the mechanism is shown in the off or unlocked position.

DETAILED DESCRIPTION OF ILLUSTRATED EMBODIMENTS

Figure 10A:
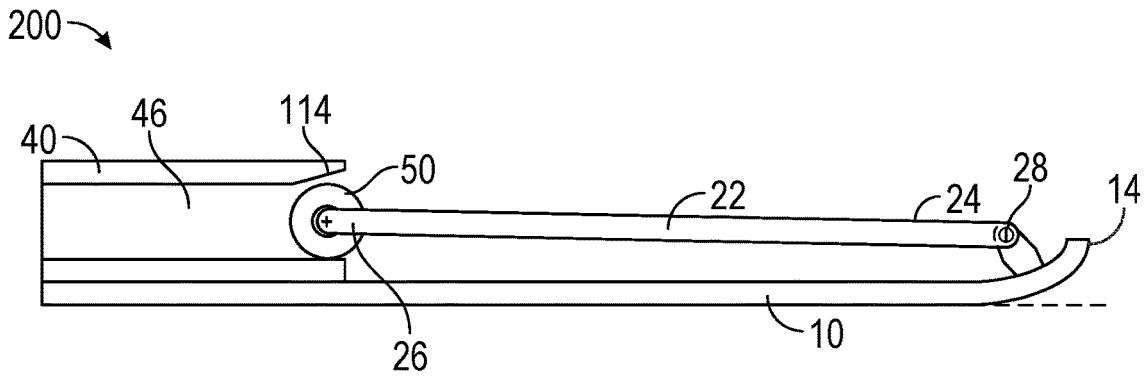
FIGS. 10A through 10C are a series of schematic drawings of an embodiment of a torsional stabilizer according to the present invention mounted to a ski and illustrating the ski progressively and sequentially as the ski de-cambers. Specifically.
Figure 10B:
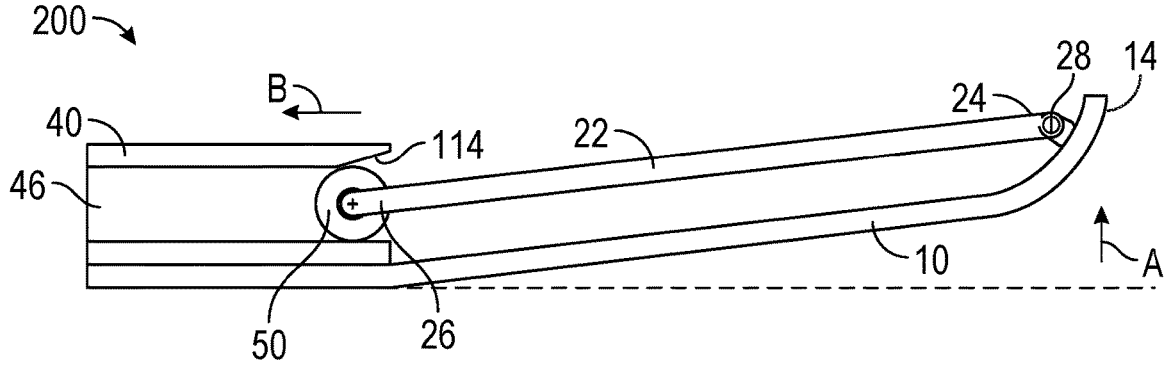
Figure 10C:
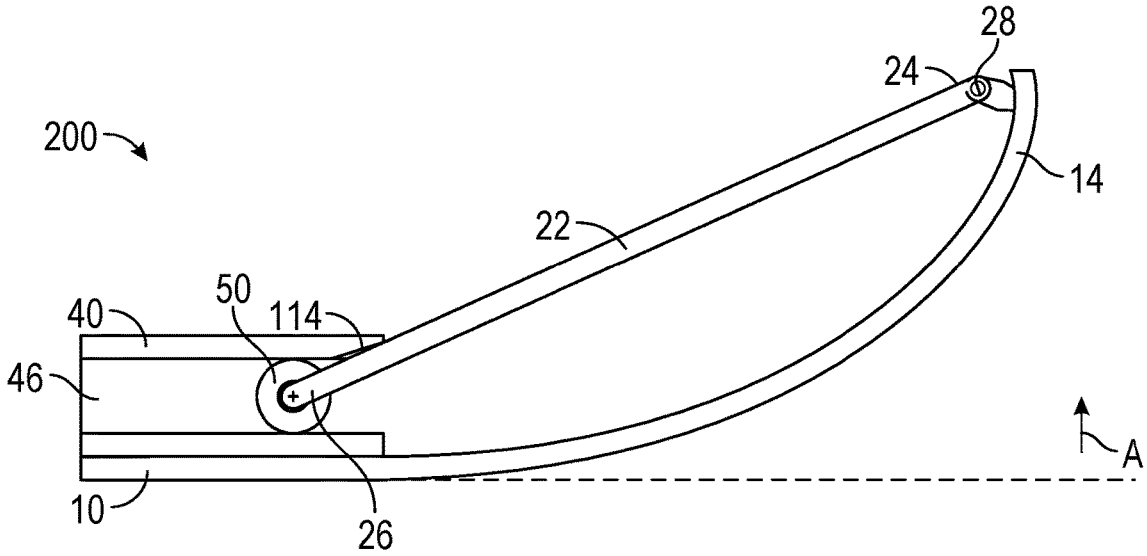

The invention will now be described in detail with reference to the drawings. It will be understood that relative directional terms are used at times to describe components of the invention and relative positions of the parts. As a naming convention, relative directional terms correspond to a horizontal surface such as a snow field that is horizontal: "upper" or "upward" refers to the direction above and away from the horizontal plane of the snow field; "lower" is generally in the opposite direction, "inward" is the direction from the exterior toward the interior of the ski, "vertical" is the direction normal to the horizontal ground plane, and so on. In addition, "de-camber" refers to the upward bending of the tip of a ski, as typically occurs during a carved turn. The series of drawings of FIGS. 10A, 10B and 10C show a sequential and increasing de-cambering of a ski. Throughout this description and in the drawings, like structures shown in the drawings are assigned the same reference numbers.

Figure 1:
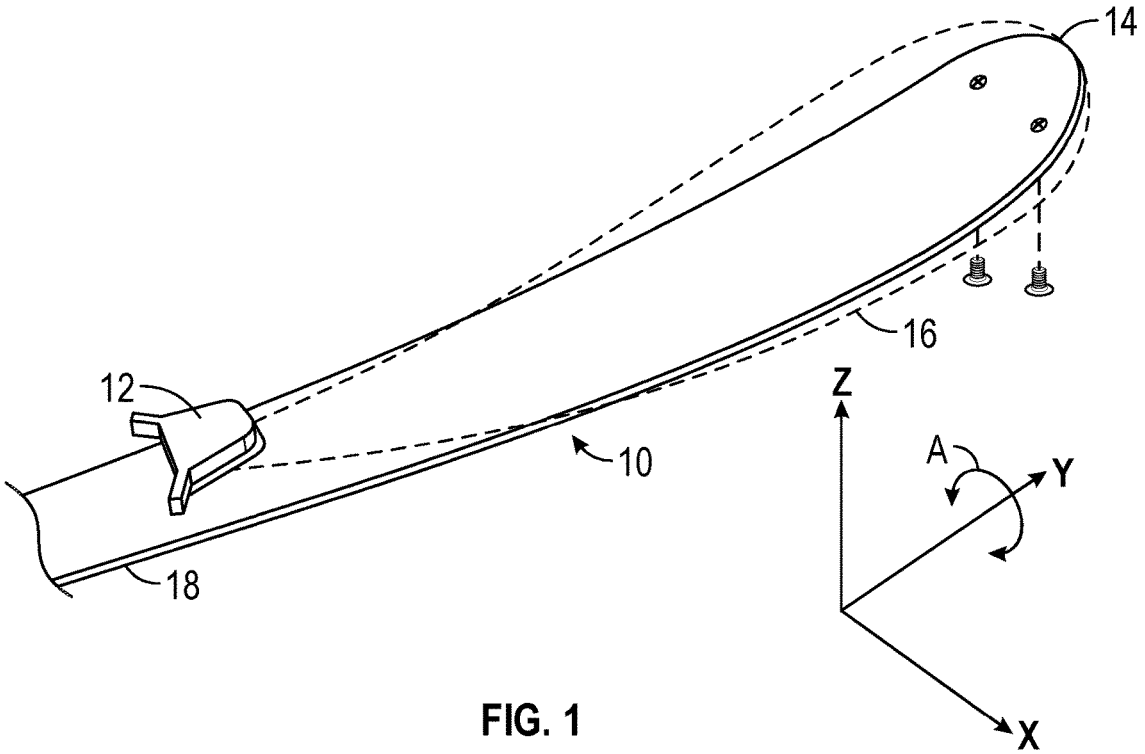
FIG. 1 is a perspective view of a ski of the type with which the torsional stabilizer according to the present invention may be used.

With reference now to FIG. 1, and continuing with background and naming information, the front of a ski 10 is shown in perspective view and a binding toe piece 12 is shown mounted to the ski. The "tip" 14 of the ski is the forward most end of the ski, and while not shown in the drawing, the tail of the ski is the opposite, rearward end of the ski. The shovel 16 is that part of the ski near the tip 14 that has the greatest width. The waist 18 is that part of the ski that has the narrowest width and which is typically located under the sole of the skier's boot, between the binding toe piece 12 and the binding heel piece (which is not shown).

The XYX coordinate grid shown in FIG. 1 is used to illustrate the different axes about which the ski may flex or bend during use. Ski 10 flexes when force is applied along the Z axis at the tip 14 (and/or at the tail) so that the ski bends or deflects at the tip (and/or tail) along the Y axis—this flexion is referred to as de-cambering. The Y axis is also the longitudinal axis of ski 10. The flexural deflection of ski 10 along the Y axis is measured as the amount of force/deflection distance. Ski 10 torsionally rotates when twisting torque is applied about the Y axis that results in a given amount of rotational deflection of the ski about the Y axis, as illustrated with arrow A in FIG. 1. The torsional rotation of ski 10, referred to herein at times as "torsional rotation" is measured as the amount of torque/the degrees of deflection.

Figure 2:
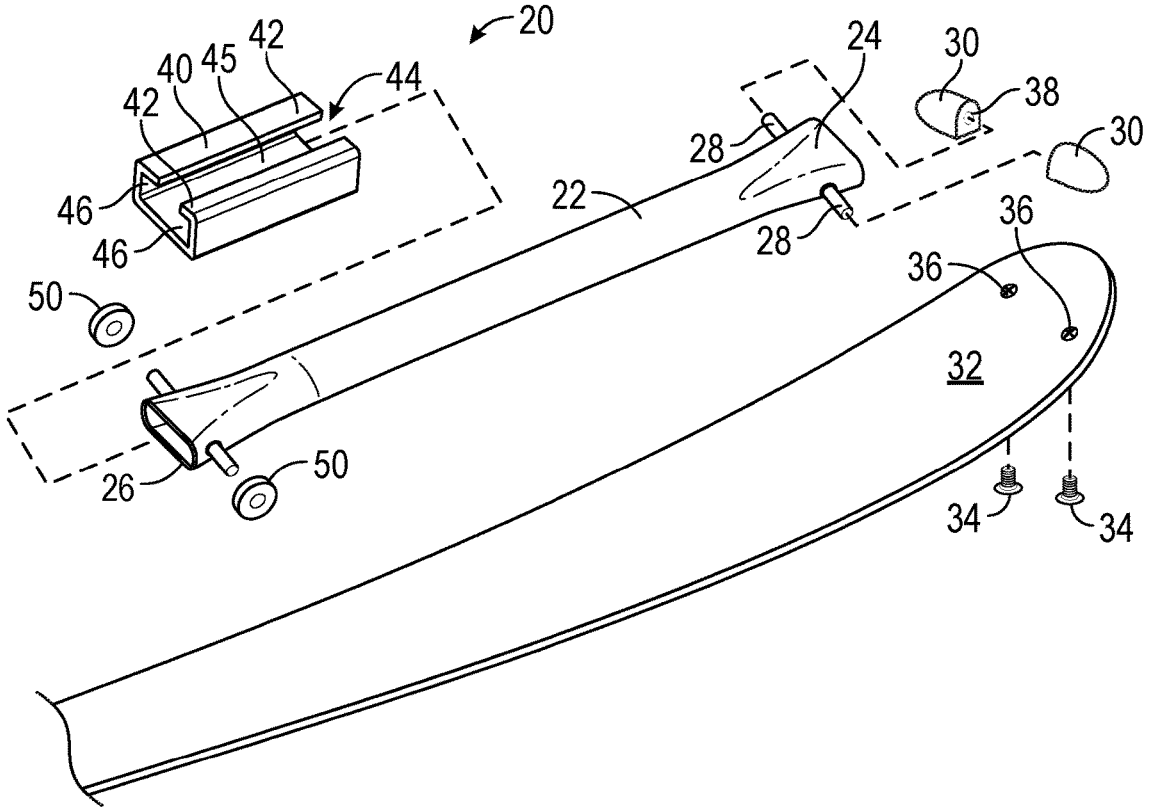
FIG. 2 is a perspective and exploded view of the ski shown in FIG. 1 with the binding toe piece removed and with a first embodiment of a torsional stabilizer according to the invention shown juxtaposed above the ski.

A first preferred and illustrated embodiment of a torsional stabilizer according to the present invention is shown in FIG. 2 and is identified generally with reference number 20. As described in greater detail below, there are numerous structural embodiments for a torsional stabilizer 20 according to the invention. However, certain structural and functional characteristics are important in several preferred embodiments, namely, the forward end of the torque tube of the torsional stabilizer is pivotally mounted near the tip 14 of ski 10 about an axis that is transverse to the longitudinal axis (i.e., Y axis) of the ski. Said another way, the forward end of the torque tube of the torsional stabilizer is mounted so that it may pivot about the X axis. The rearward end of the torque tube of the torsional stabilizer is adapted to translate or slide in a fore/aft movement relative to the ski along the Y axis as the ski de-cambers; there are several mechanisms that facilitate the translational movement of the rearward end of the torque tube of the torsional stabilizer. As the rear end of the torque tube translates or slides relative to the ski, the mechanisms that retain the rear end of the torque tube prevent rotational twisting of the ski about the Y axis. Thus, while the ski fitted with a torsional stabilizer 20 according to the invention is free to de-camber during a carved turn, the ski cannot torsionally twist; this prevents or minimizes skidding of the ski during a turn.

In other preferred embodiments, a dynamic torsional stabilization mechanism provides for a gradual decrease in the degree of torsional twisting of the ski that is allowed as the amount of flex of the ski increases. In these embodiments, when the ski is flat the dynamic torsional stabilizing mechanism allows the ski to twist about the Y axis. This can be a benefit, for example, when a skier is skating across a flat or relatively flat section of snow, or when the skier is performing relatively slow and relaxed carved turns that cause relatively little de-camber. But at the intensity of the turns increases with increased flex of the ski, the dynamic torsional stabilizing mechanisms prevents twisting of the ski about the Y axis to increase the carving of the ski while preventing skidding.

In still other embodiments, an on-off mechanism in the torsional stabilizing mechanisms according to the present invention allows a skier to selectively engage and disengage the torsional stabilizer.

With reference now to FIG. 2, a first preferred embodiment of a ski torsional stabilizer 20 according to the present invention is shown juxtaposed next to a ski 10 that is typical of the type with which the stabilizer 20 is used. The torsional stabilizer comprises an elongate member that is a stabilizer tube 22 that has a forward end 24 and a rearward end 26. The stabilizer tube 22 is substantially rigid longitudinally (i.e., along the Y axis) and substantially rigid torsionally so that it may not be twisted about the Y axis—that is, the tube 22 cannot be twisted in the rotational directions shown by arrow A of FIG. 1 when torque is applied to the tube. Those of skill in the art will recognize that absolute torsional rigidity is not easily obtainable with any material. Accordingly, when the stabilizer tube herein is referred to herein as being torsionally rigid, it is to be understood that the tube is substantially rigid considering the amount of force that is applied to the tube in the context of its use on skis. The stabilizer tube is preferably fabricated from a lightweight material that is axially non-rotatable under torque, such as thin-walled aluminum, fiberglass or carbon fiber composites. The forward end 24 of tube 22 is mounted near but immediately rearward or posteriorly of the tip 14 of ski 10, and as noted above, is mounted so that the tube is pivotally rotatable about an axis that is transverse to the Y axis. As detailed below, there are numerous equivalent structures that may be used to mount the forward end 24 to ski 10. In the embodiment of FIG. 2, pivot pins 28 extend outwardly and oppositely from tube 22 near the forward end 24 and define a forward hinge or axle axis; the reference number 28 identifies the pivot pins and the associated forward hinge axis. A pair of pivot blocks 30 is mounted to the upper surface 32 of ski 10 on opposite sides of the ski (for example, with through screws or bolts 34 that extend through bores 36 drilled through ski 10 (typically forward of the portion of the ski that is in contact with snow)—the bolts 34 thread into threaded bores in the lower surface of the pivot blocks (not shown in FIG. 2—see FIG. 6, below)). The pins 28 are received in facing bores 38 in the pivot blocks and the stabilizer tube 22 is thus pivotal about the axis defined by the pins 28. The pivot blocks 30 may be attached to ski 10 in any appropriate manner, including for example, adhesives.

Figure 9A:
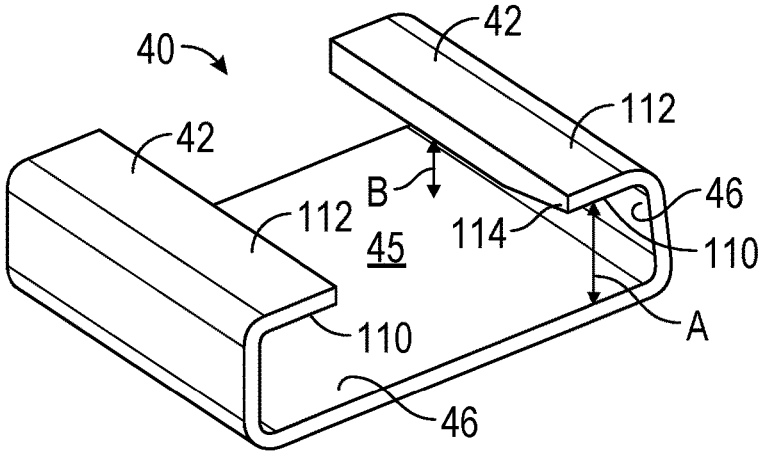
FIG. 9A is a perspective view of a slider channel according to the present invention.

The rearward end 26 of stabilizer tube 22 is mounted to ski 10 such that the end 26 is movable along the Y axis as the ski flexes, yet, as detailed above, such that the tube cannot twist about the Y axis as torque is applied to the ski. In the embodiment shown in FIG. 2, a slider channel 40 is mounted to the upper surface 32 of ski 10 forward (anteriorly) of binding toe piece 12 (not shown in FIG. 2, reference FIG. 1) and in a position such that the rearward end 26 of tube 22 resides within the bounds of the slider channel. The slider channel 40 is preferably fabricated from a strong, light weight material such as aluminum or carbon fiber composite, and may be mounted to the ski 10 with adhesives such as epoxy or with screws. As seen in FIG. 2 and as shown in FIG. 9, which illustrates one possible embodiment of a slider channel 40, the slider channel is a substantially C-shaped piece in which the long part of the C—the base 45—is mounted to the ski 10. The inwardly projecting arms 42 define a bounded space 44 that includes opposed tracks 46 that are defined by the arms 42. The opposed tracks 46 extend along the Y axis and are thus the portion of the bounded space 44 between the inwardly projecting arms 42 and the base 45 of the of the slider channel 40.

A pair of axle pins 48 are mounted to the rearward end 26 of stabilizer tube 22 in the same manner as pivot pins 28 are mounted near the forward end of the tube and such that the axle pins 48 extend outwardly from the tube, parallel to the X axis. A wheel 50 is mounted to the outer end of each axle pin 48. The wheels 50 are preferably fabricated from Teflon or Delrin type of material and have a diameter that is substantially the same as the width of tracks 46. That is, the width of tracks 46 is the distance from the base 45 of the slider channel 40 to the facing inner surfaces of the inwardly projecting arms 42, and the diameter of wheels 50 is substantially the same as that width. The wheels may include bearings, but that is optional. Moreover, in some embodiments the wheels may be replaced with blocks of Teflon or Delrin material that are received in the tracks 46. And the facing surfaces of tracks 46 that are in contact with the Teflon or Delrin of wheels 50 (or blocks of such material, as the case may be) may be coated with low friction materials such as Teflon or Delrin.

In the assembled unit, the wheels 50 are received in the tracks 46. Because the wheels have a diameter that is the same as the width of the tracks 46 the wheels are in contact with the surfaces of the slider block 40 when the wheels are received in the slider block and there is very little or no tolerance between the wheels and the contacting surfaces. As such, as torque is applied to the ski (i.e., twisting force about the Y axis), the wheels prevent rotation of stabilizer tube 22. However, the wheels are able to move forward and rearward along the Y axis as the ski flexes. Thus, when the tip 14 of ski 10 is pushed upwardly—as the ski de-cambers in a turn—the rearward end 26 of stabilizer tube 22 is pushed toward the rear of the ski and wheels 50 slide in tracks 46 of slider block 40. The ski freely de-cambers but cannot twist under the torque applied to the ski.

This principle of operation is illustrated graphically and somewhat schematically in the series of drawings of FIGS. 10A, 10B and 10C. With reference to those figures the slider block 40 is modified relative to the slider block 40 shown in FIG. 2 (as detailed below). But beginning with FIG. 10A the ski 10 is sitting flat—the ski is not being de-cambered. In this position the wheels 50 (only one of which is visible) rests in channel 46 of slider block 40. In FIG. 10B the tip 14 of ski 10 is being flexed upwardly (arrow A)—that is, the front of the ski is being flexed along the Y axis as would occur in a moderate carving turn. As this happens, the forward end 24 of stabilizer tube 22 pivots about pins 28 and the rearward end 26 of tube 22 is pushed rearwardly as shown by arrow B. Wheels 50 are retained in channel 46 and the ski is thus unable to rotate torsionally during the turn. FIG. 10C continues the sequence and illustrates what happens when the turn becomes very intense—the tip 14 of ski 10 flexes to a greater extend (arrow A) and the rearward end 26 of tube 22 is pushed further toward the tail of the ski with the wheels 50 translating in channels 46. Of course, as the skier finishes the turn and the ski flattens out, the reverse process takes place with the ski returning to the position shown in FIG. 10A—the interconnection between the rearward end 26 of tube 22 and slider block 40, as described and shown, does not interfere with flexion of the ski along the longitudinal axis but prevents axial rotation of the ski.

The sequential drawings of FIGS. 10A through 10C thus illustrate an important functional aspect of torsional stabilizer 20, namely, as the ski flexes during a turn—that is, as the ski de-cambers—the stabilizer tube 22 pivots at its fixed forward end 24 about a pivot axis that is transverse to the longitudinal axis of the ski. As this occurs, the movable rearward end 26 of the stabilizer tube translates in a mounting structure that allows unrestricted movement along the longitudinal axis but restricts rotational twisting about the Y axis. Thus, as the tip of the ski flexes upwardly the rearward end 26 moves rearwardly, translating in the mounting structure.

Figure 9B:
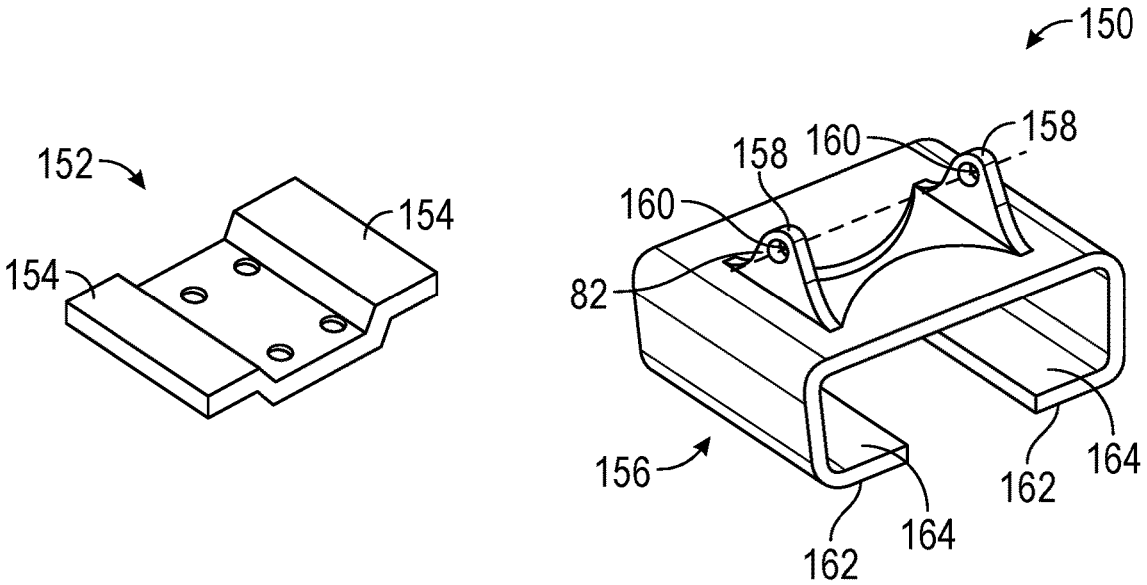
FIG. 9B is a perspective and exploded view of an alternative embodiment of a slider plate according to the present invention.

An alternative form of a slider plate assembly 150 is shown in FIG. 9B; the alternative form may be used as an equivalent replacement for the slider channel 40 described above. Slider plate assembly 150 is defined by an anchor plate 152 that is mounted to the upper surface 32 of a ski 10 just forward of the binding toe piece and includes opposed outward wings 154 that are elevated above surface 32 when the anchor plate 152 is mounted to the ski. The second component of slider plate assembly 150 is a slider plate 156 that is generally C-shaped and which includes upwardly extending mounts 158 with aligned bores 160 to which the rearward end 26 of a stabilizer tube 22 are pivotally attached and which thus define a rear hinge axis 82 that extends along the X axis and about which the stabilizer tube may pivot. Slider plate 156 has opposed downwardly and inwardly projecting arms 162 that define opposed channels 164. In the assembled slider plate assembly 150, the wings 154 of anchor plate 152 are inserted into the channels 164 of the slider plate 156 and the slider plate is able to translate in forward and rearward directions on the anchor plate as the ski flexes. The tolerance or clearance between the facing surfaces of the wings 154 and the channels 164 is very tight so that translational sliding along the Y axis allowed but there is no rotation of the slider plate relative to the anchor plate about the Y axis. If desired, the facing surfaces may be coated with a low friction material such as Teflon or Delrin to facilitate smooth translation of the slider plate on the anchor, if desired.

It will be appreciated that since skis are used in harsh conditions there always is a possibility of snow and ice accumulating on the skis and on structures such as slider channel 40 and pivot block 30. However, snow and ice accumulation is typically not an impediment to proper functional operation of torsional stabilizer 20 according to the present invention because, among other things, the forces applied to the interacting structures (such as rearward end 26 of stabilizer tube 22 as it translates in slider channel 40) are significant enough to easily clear any accumulated snow and ice. The bounded space 44 of slider channel 40 is open at its forward and aft ends and thus facilitates removal of accumulated snow and ice therefrom. Moreover, the cross sectional shape of stabilizer tube 22 may be varied to enhance the ability of the tube to shed ice, so long as its torsional rigidity is maintained.

Reference is now made to FIGS. 6, 7 and 8, which illustrate alternative and equivalent structures for pivotally mounting forward end 24 of stabilizer tube 22 to ski 10. The pivot block 30 detailed above in respect of FIG. 2 is shown in the series of drawings of FIGS. 6A through 6E. In the case of the pivot block 30 shown in FIG. 6, the block includes a threaded bore 60 into which a bolt 34 is threaded to mount the pivot block to the upper surface 34 of ski 10. The bore 38 in the pivot block defines the receptacle for pivot pins 28 and thus defines the axis of pivotal rotation of the stabilizer tube 22 at its forward end 24.

A first alternative structure for pivotally mounting forward end 24 of stabilizer 22 to ski 10 is shown in FIGS. 7A through 7D. In this embodiment a front axle pivot plate 62 has a flattened center portion 64 that is mounted to upper surface 32 of ski 10 and opposite upright arms 66, each of which includes an axle bore 68. The bores 68 are laterally aligned and the pivot pins 28 are received in the bores 68 so the stabilizer tube 22 is pivotal about the axle axis defined by the pivot pins.

Yet another equivalent alternative structure for pivotally mounting forward end 24 of stabilizer tube 22 to ski 10 is shown in FIGS. 8A through 8D. Here, a pivot clamp 70 is defined by a C-shaped lower section 72 that mechanically clamps to the sidewall of ski 10 (since the clamp is mounted near the tip 14 of the ski 10, the portion of the C-shaped lower section 72 that extends under the ski—over the edge of the ski and onto the base, the clamp 70 does not under normal use conditions interfere with performance of the ski). An arm 74 extends upwardly from the upper surface of the ski and includes a pivot pin bore 76. When two clamps 70 are mounted to a ski 10 on opposite lateral sides of the ski (the two clamps are mirror images of one another), the pivot pin bores 76 align and the pivot pins 28 are received in the bores 76 so the stabilizer tube 22 is pivotal about the axle axis defined by the pivot pins.

From study of the structures shown in FIGS. 2 and 6 through 8, those of ordinary skill in the art will appreciate that there are other structures that are functionally equivalent for pivotally mounting the forward end of the stabilizer tube to the ski. And while FIG. 2 and FIGS. 10A, 10B and 10C show just the portion of ski 10 forward of the binding toe piece 12, it will be appreciated that the tail of the ski—that portion of the ski behind the binding heel piece—may be torsionally stiffened in the same manner with the same torsional stabilizer 20 as described herein.

Figure 3A:
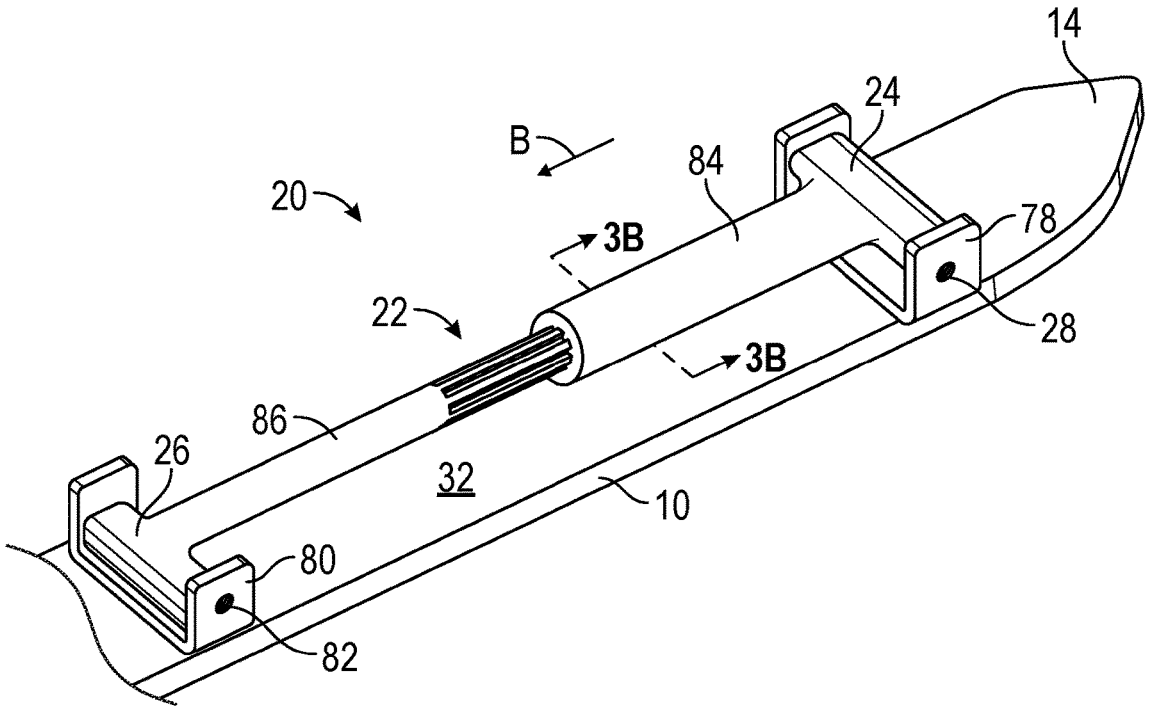
FIG. 3A is a perspective view of a ski with a second embodiment of a torsional stabilizer according to the invention mounted to the ski.
Figure 3B:
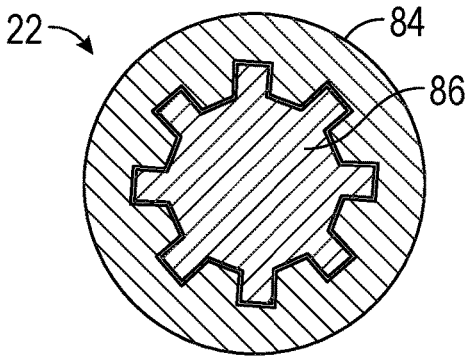
FIG. 3B is a cross sectional view through the torsional stabilizer shown in FIG. 3A and taken along the line 3B-3B of FIG. 3A.

Turning now to FIG. 3A, an alternative embodiment of a torsional stabilizer 20 according the present invention is shown. In the embodiment of FIG. 3A the forward end of the stabilizer tube 22 is hingedly attached to a front axle pivot bracket 78 (which is fixed to the upper surface 32 of ski 10) at a front hinge axis 28, and the rearward end 26 of the stabilizer tube is similarly fixed to a rear axle pivot bracket 80 (also fixed to the ski) at a rear hinge axis 82. However, the stabilizer tube 22 of FIG. 3A is split into a front outer spline tube 84 and a rear inner spline shaft 86 that is slidably received in the outer spline tube so that the inner spline shaft may move longitudinally within the outer spline tube, and vice versa. The cross sectional view of FIG. 3B illustrates how the inner spline shaft 86 slips into the cooperatively formed outer spline tube 84.

It will be appreciated that as the tip 14 of ski to flexes upwardly as shown in the series of FIGS. 10A, 10B and 10C, the stabilizer tube 22 pivots about front pivot axis 28 and the outer spline tube 82 slides rearwardly in the direction of arrow B over inner spline shaft 86. There may also be some pivoting of about the rear hinge axis 82, depending upon the degree of de-cambering. As the ski flexes along the Y axis the torsional stabilizer 20, with its fixed forward and rearward ends and spline shaft/spine tube connection, prevents axial rotation of the ski about the Y axis.

Figure 4A:
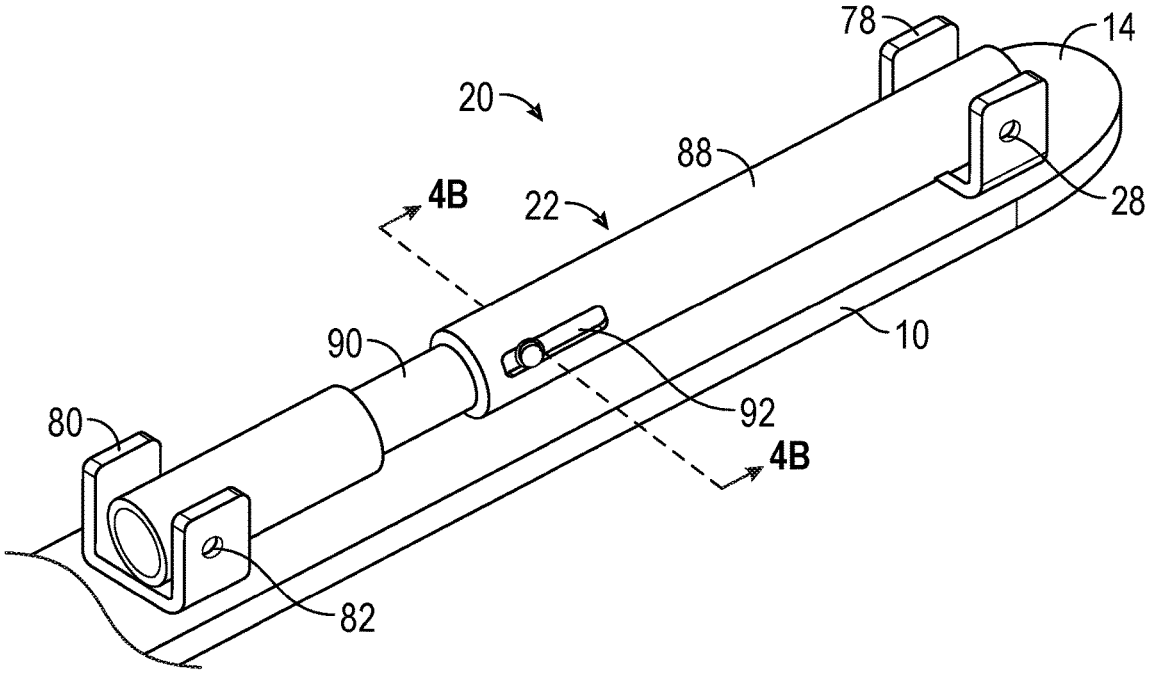
FIG. 4A is a perspective view of a ski with a third embodiment of a torsional stabilizer according to the invention mounted to the ski.
Figure 4B:
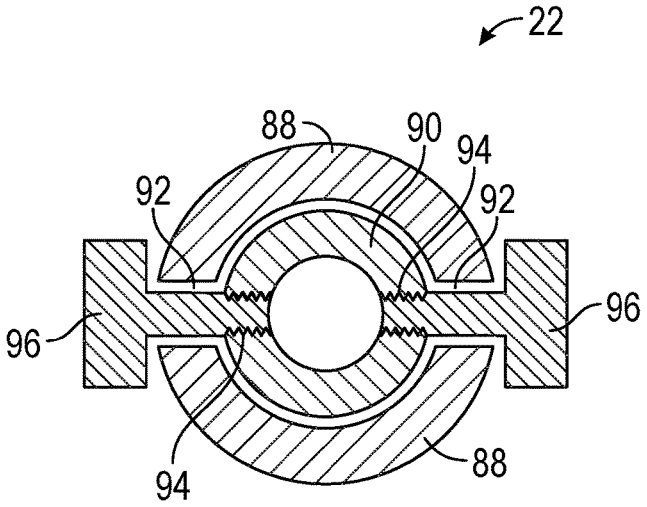
FIG. 4B is a cross sectional view through the torsional stabilizer shown in FIG. 4A and taken along the line 4B-4B of FIG. 4A.

Yet another embodiment of a torsional stabilizer 20 according to the invention is shown in FIGS. 4A and 4B. In this embodiment, like the embodiment of FIG. 3A, the forward and rearward ends 24 and 26, respectively, of the stabilizer tube 22 are pivotally fixed to the ski 10 at a front hinge axis 28 and a rear hinge axis 82. The stabilizer tube 22 is split into a forward outer tube 88 and a rear inner tube 90 that is slidably inserted into the outer tube, as shown. A pair of longitudinally extending and closed end slots 92 are formed in forward outer tube 88 and, with reference to the cross section of FIG. 4B, a pair of threaded bores 94 are formed in the inner tube 90 within the portion of the inner tube that is exposed in the slots 92. Shoulder screws 96 are threaded into bores 94 as shown in FIG. 4B. It will be understood that the outer tube 88 is longitudinally slidable along inner tube 90 and that as the tubes slide relative to one another the shoulder screws 94 move in slots 92. However, any torque applied to ski 10 that would cause twisting rotation of the ski about the Y axis causes the shoulder screws 94 to bear upon the sides of the slots 92, which thereby prevents axial rotation of the ski.

Figure 5A:
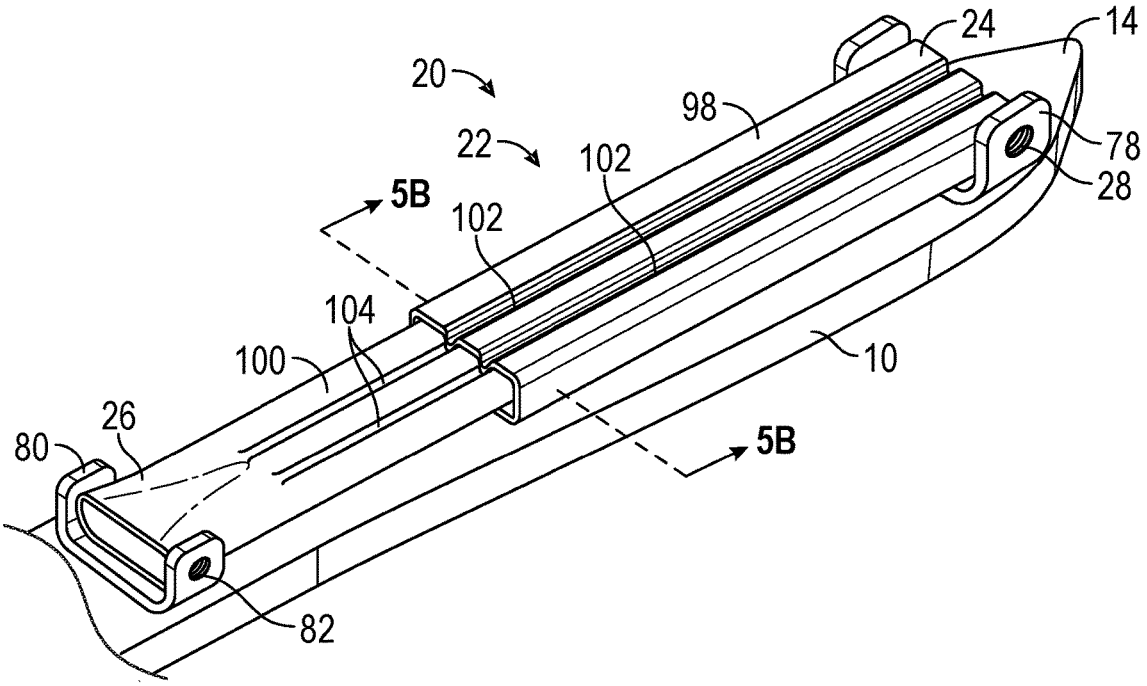
FIG. 5A is a perspective view of a ski with a fourth embodiment of a torsional stabilizer according to the invention mounted to the ski.
Figure 5B:
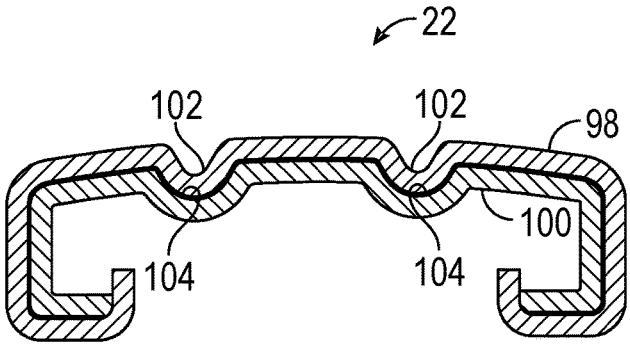
FIG. 5B is a cross sectional view through the torsional stabilizer shown in FIG. 5A and taken along the line 5B-5B of FIG. 5A.
Figure 6A:
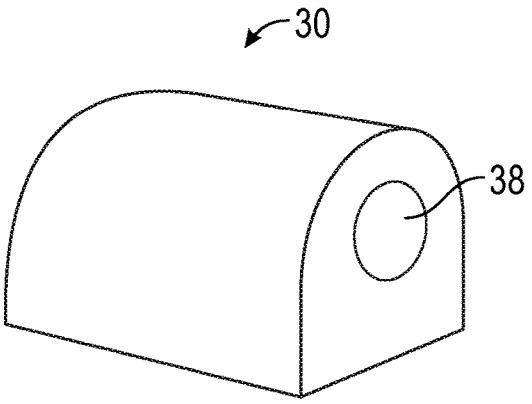
FIGS. 6A through 6E are a series of different views of a front axle pivot block that provides the pivot point for the front, forward end of the stabilizer tube. Specifically.
Figure 6B:
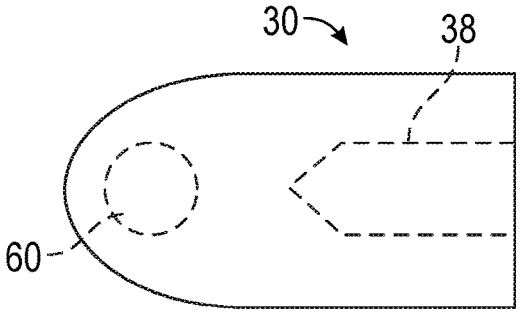
Figure 6C:
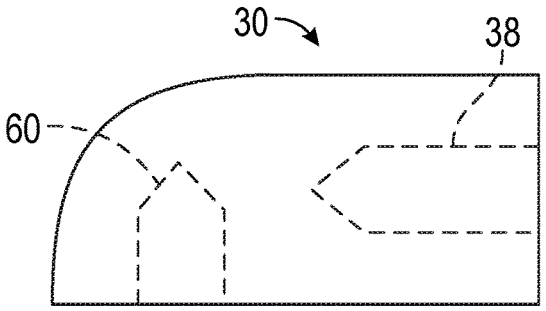
Figure 6D:
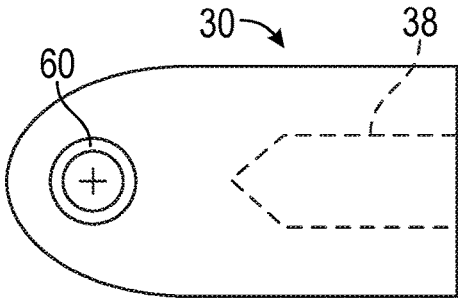
Figure 6E:
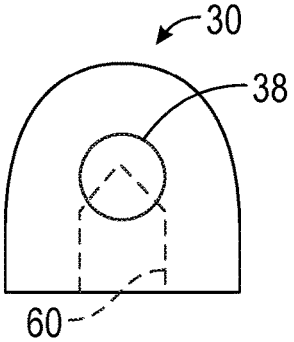
Figure 7A:
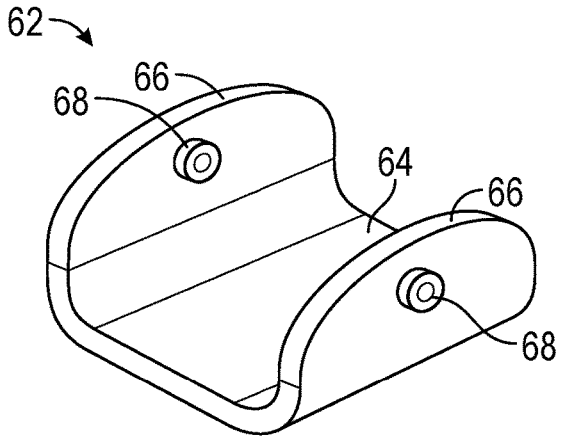
FIGS. 7A through 7D are a series of different views of a front axle pivot plate that is an alternative structure to the pivot block shown in FIGS. 6A through 6E and which provides the pivot point for the front, forward end of the stabilizer tube. Specifically.
Figure 7B:
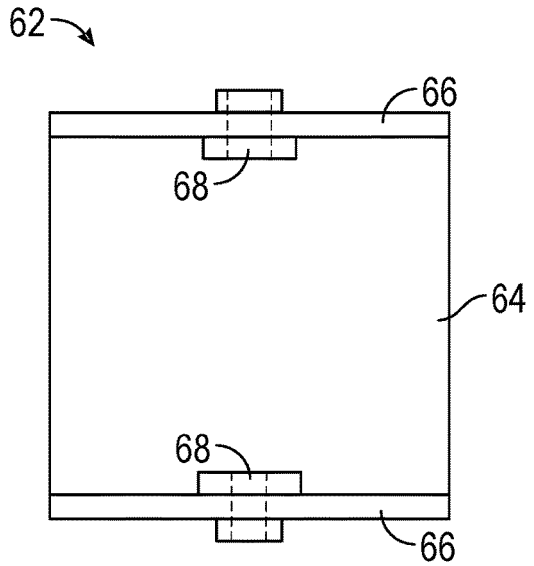
Figure 7C:
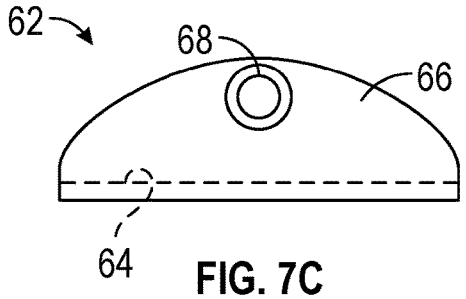
Figure 7D:
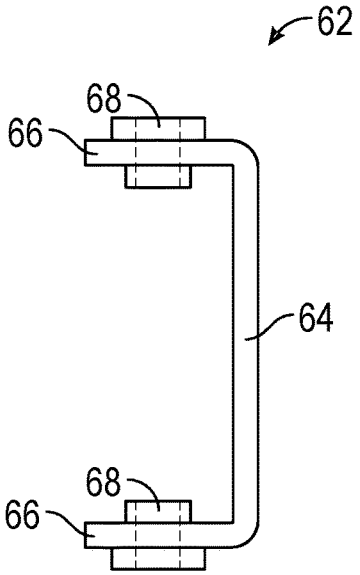
Figure 8A:
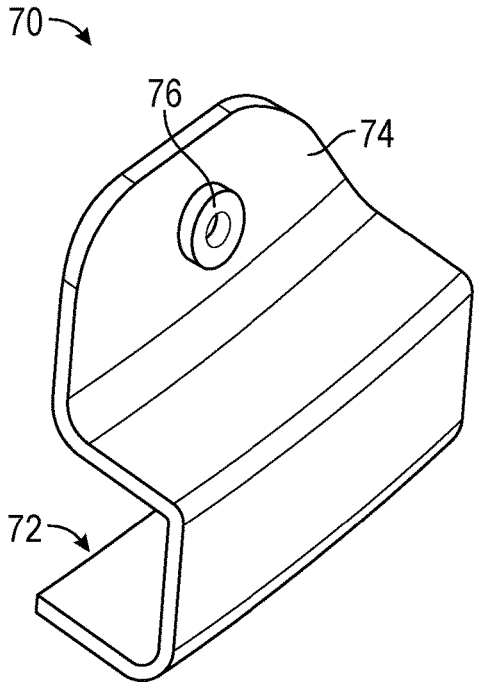
FIGS. 8A through 8D are a series of different views of a front axle pivot clamp that is an alternative structure to the pivot block shown in FIGS. 6A through 6E and which provides the pivot point for the front, forward end of the stabilizer tube. Specifically.
Figure 8B:
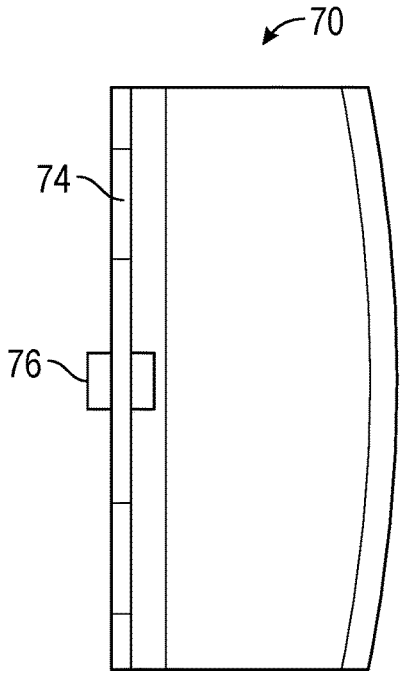
Figure 8C:
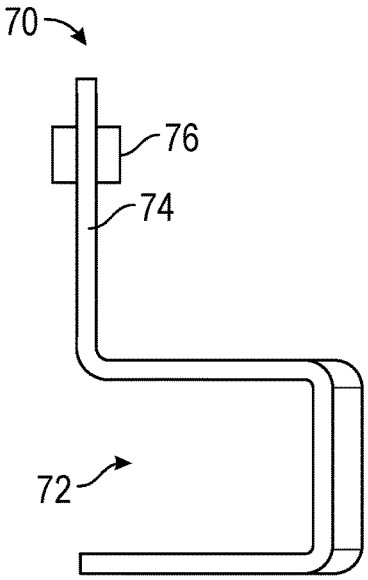
Figure 8D:
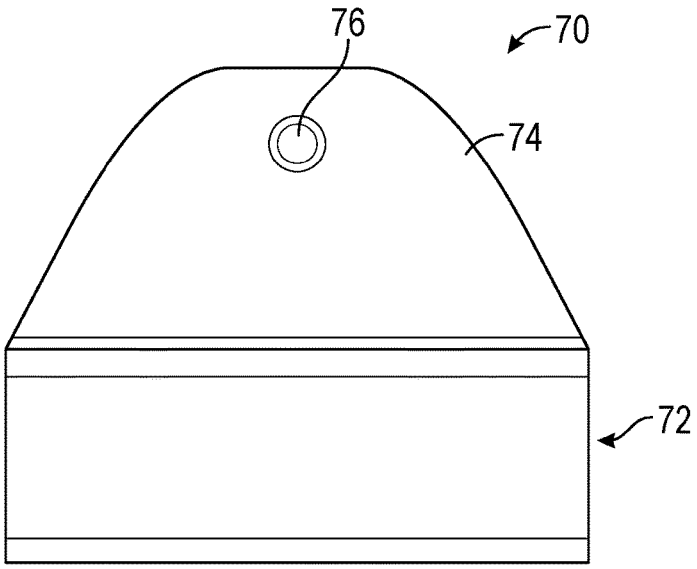

Still another embodiment of a torsional stabilizer 20 according to the invention is shown in FIGS. 5A and 5B. Like the embodiments described above with reference to FIGS. 3A and 4A, the embodiment of FIG. 5A has a stabilizer tube 22 that has its forward end 24 pivotally fixed at a forward hinge axis defined by front axle pivot bracket 78 and its rearward end 26 pivotally fixed at a rear axle pivot bracket 80 that defines a rear hinge axis 82. The stabilizer tube 22 comprises a forward section 98 and a rearward section 100 that are cooperatively shaped (as shown in the cross sectional drawing of FIG. 5B) to allow relative longitudinal translation of the forward and rearward sections 98 and 100 as the ski 10 flexes, but to prevent axial rotation of the ski about the Y axis. With specific reference to FIG. 5B, forward section 98 defines a pair of parallel longitudinally extending and downwardly extending troughs 102 that are received in cooperatively shaped and located longitudinal grooves 104 in rearward section 100. Again, while the two sections defined by forward section 98 and rearward section 100 are capable of longitudinal translation relative to one another as ski 10 de-cambers, the interaction of the two sections prevents axial rotation of the ski.

It will be appreciated that when the torsional stabilizer 20 is of the type that has fixed forward and rearward ends such as the embodiments of FIGS. 3, 4 and 5, the function of preventing axial rotation of the ski may be accomplished with any non-circular arrangement of inner to outer tubes that define the stabilizer tube 22.

Figure 22:
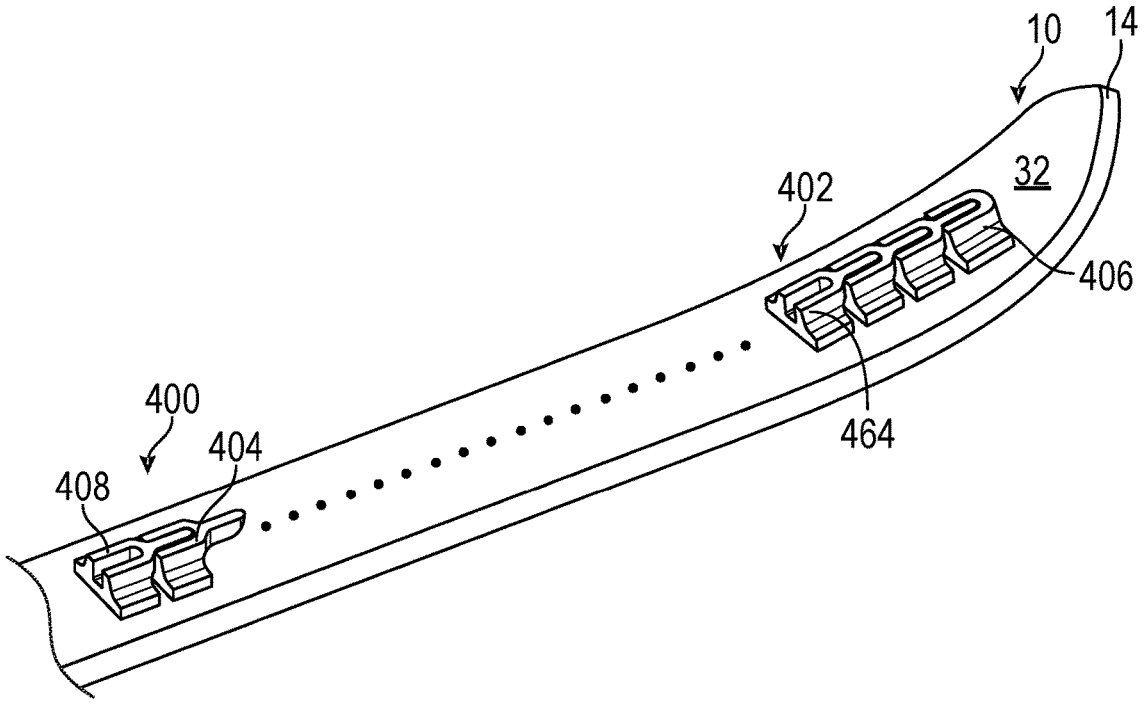
FIG. 22 is a perspective and partial view of yet another embodiment of a torsional stabilizer according to the present invention.
Figure 23:
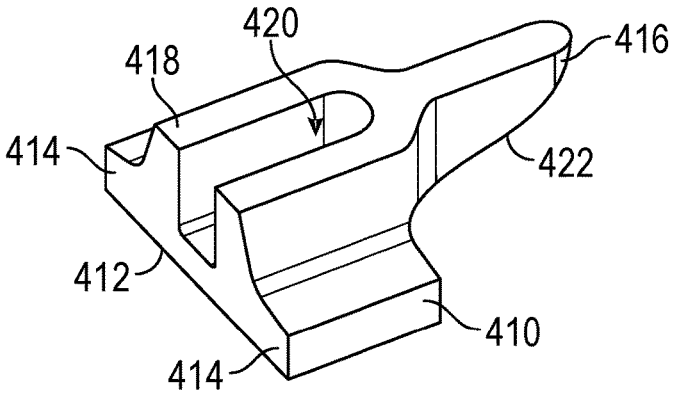
FIG. 23 is a close up view of a single component of the torsional stabilizer shown in FIG. 22.

Reference is now made to the drawings of FIGS. 22 and 23 in which yet another embodiment of a torsional stabilizer 400 according to the invention is illustrated. It will be readily apparent that the torsional stabilizer 400 is structurally different from the other embodiments described herein and shown in the drawings. However, from an operational point of view the torsional stabilizer 400 is functionally identical to the other embodiments.

Torsional stabilizer 400 is defined by an exoskeleton structure 402 that comprises plural vertebrae 404 that are individually attached to the upper surface 32 of ski 10 posteriorly of tip 14 and anteriorly of the binding toe piece (which is not shown in FIG. 22). In FIG. 22 only some of the plural vertebrae 404 are illustrated in order to better show the structure of the individual parts. It will be appreciated however that the exoskeleton structure 402 is a continuous set of individual vertebrae 404 that extends from the forward most vertebrae 406 to the rearward most vertebrae 408.

An individual vertebra 404 is shown in isolation in FIG. 23. Each vertebra 404 that defines the exoskeleton structure 402 may be identical, although as noted below the vertebrae 406 and 408 at the forward and rearward ends of the structure 402 may be constructed slightly differently for cosmetic purposes. Vertebrae 404 is preferably a unitary member that has a widened base 410 that defines a planar lower surface 412 and which has outwardly extending and opposed arms 414. A rib 416 extends forwardly from opposed arms 418 that define a slot 420 therebetween—the slot opens rearwardly as shown, and the lower surface 422 of rib 416 is elevated above the lower surface 412. The lower surface 422 of rib 416 tapers and curves upwardly moving in the forward direction, as shown. The width of rib 416 (W1 in FIG. 23) is the same as or marginally less than the width W2 of slot 420 so that a rib 416 of one vertebrae 404 may be inserted into a slot 420 of an adjacent vertebrae 404.

Plural vertebrae 404 (the number depending upon the length of ski 10) are attached to the upper surface 32 of ski 10 along the longitudinal centerline of the ski. Each vertebra may be attached with, for example, adhesives or fasteners extending through the arms 414 and into the ski. The forward-extending rib 416 of one vertebra 404 is received into the rearward opening slot 420 of the adjacent and immediately forward oriented vertebrae 404. As noted, the width of rib 416 is nearly the same as the width of slot 420. As such, when two adjacent vertebrae 404 are assembled as shown and described, the abutting relationship of the rib 416 in the slot 420 prevents the two vertebrae from axial rotation (axial meaning in reference to the Y axis of ski 10). When plural vertebrae 404 are attached to ski 10, the ski is free to flex, de-camber, along the Y axis given the upwardly curved structure of the lower surface 422 of each rib 416 and the slots 420 in which the ribs are received. However, the exoskeleton 402 defined by the plural vertebrae 404 prevents axial rotation of the ski. As noted above, the forward most vertebrae 406 and the rearward most vertebrae 408 in an exoskeleton 402 may be formed somewhat differently from the other vertebrae 404. Specifically, the rib 416 may be omitted from vertebrae 406 and the slot 420 may be omitted from the vertebrae 408 since there is no vertebrae 404 forward of vertebrae 406 and no vertebrae 404 rearward of vertebrae 408.

Turning now to FIG. 3A, an alternative embodiment of a torsional stabilizer 20 according the present invention is shown. In the embodiment of FIG. 3A the forward end of the stabilizer tube 22 is hingedly attached to a front axle pivot bracket 78 (which is fixed to the upper surface 32 of ski 10) at a front hinge axis 28, and the rearward end 26 of the stabilizer tube is similarly fixed to a rear axle pivot bracket 80 (also fixed to the ski) at a rear hinge axis 82.

At times, skiers may desire relatively soft or light torsional rigidity in their skis. Typically when the ski is flat (i.e., when it is not angles about its longitudinal axis onto one edge or the other) it may be desirable for a ski to be able axially twist relatively easily. One example of this is to avoid hanging or catching an edge while trying to steer or twist the ski into the yaw axis. In this scenario, the ski has not been significantly pressured or loaded and as a result, hand not been bend backwards or de-cambered. The embodiments of a dynamic torsional stabilizer 200 according to the present invention that are described below incorporate a variable and dynamic torsional rigidity to the ski to exhibit greater or increasing torsional rigidity dynamically as the ski is loaded and de-cambered. As will be evident form the discussion below and the drawings, with the dynamic torsional rigidity the torsional stiffness of the ski varies from a minimal stiffness as provided by the ski manufacturer to the maximum level of torsional rigidity delivered by the torsional stabilizer 20 according to the invention.

Figure 21A:
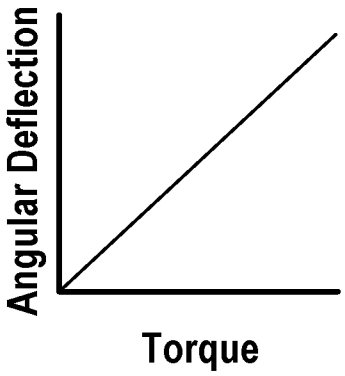
FIGS. 21A through 21D are a series of graphs plotting the angular deflection of the ski (a) as a function of the torque applied to the ski about the ski's longitudinal axis.

When a dynamic torsional stabilizing mechanism 200 is used the ski is adapted for performance in each of two different operational regimes. The first is the torsional stiffness of the ski as it was designed and built by the ski manufacturer and the second is when the torsional stabilizer 20 according to the invention is either fully engaged, or in the case of the dynamic torsional stabilizer 200, at least partially engaged. These different operational paradigms are illustrated graphically in the four graphs shown in FIGS. 21A through 21D. With reference to the graph of FIG. 21A, an example of a ski's torsional stiffness as delivered by the ski manufacture is illustrated. The angular deflection of the ski, a, is plotted on the y coordinate axis and the magnitude of torque T that is applied to the ski (i.e., the twisting force about the longitudinal axis of the ski) is plotted on the x axis. With the particular ski that is used to generate the graph of FIG. 21A it may be seen that the angular deflection is essentially a linear function of the torque throughout the entire range. In contrast, at the other end of the spectrum, in the graph of FIG. 21D the same coordinates are graphed for a ski such as that shown in FIG. 2 in which the angular deflection of the ski is at all times restricted by the torsional stabilizer 20 according to the invention. In other words, regardless of the amount of torque that is applied to the ski, the angular deflection remains near zero. The point Z shown on the x coordinate axis represents the point where the angular deflection of the ski is stopped by the torsional stabilizer 20—in the case of FIG. 21D the point Z is near the origin. It will be appreciated that the curve shown in the graph of FIG. 21D is the same for the ski 10 illustrated in FIG. 10C, which uses the dynamic torsional stabilizer 200 according to the invention.

Figure 21B:
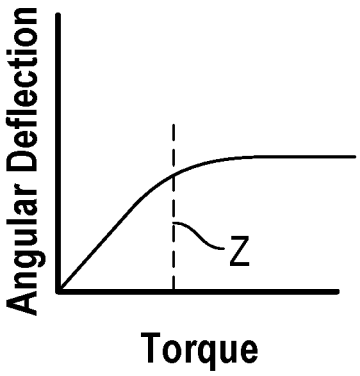
Figure 21C:
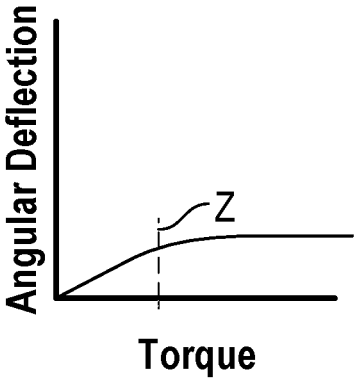
Figure 21D:
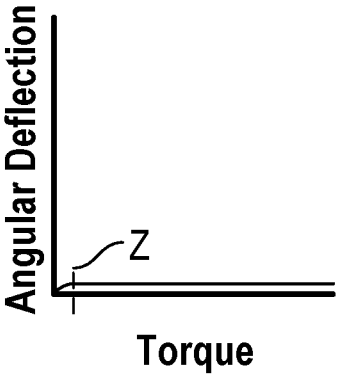

The graph of FIG. 21B illustrates the same ski that has a dynamic torsional stabilizer 200 mounted to it. The graph of FIG. 21B illustrates minimal or no flexion (i.e., de-cambering of the ski) and corresponds to the ski shown in FIG. 10A. Here, the ski is capable of angular deflection up until the point Z on the x axis, which is the point where the wheels 50 of FIG. 10A engage the slider channel 40 to prevent any further torsional rotation. Graph 21B corresponds to FIG. 10B, where the ski is exhibiting a moderate degree of flexion along the longitudinal axis of the ski (i.e., the Y axis of the ski). In this case the wheels 50 have engaged the slider channel 40 to prevent torsional twisting and the point Z on the graph has been moved to the left on the x axis and the angular deflection is lesser.

Reference is now made to the specific slider channel 40 that is shown in FIG. 9. This slider channel 40 is similar to that shown in FIG. 2. However, the inner facing surfaces 110 of the forward ends 112 of each of the inwardly projecting arms 42 has been beveled from front toward back such that they exhibit additional clearance toward the front of the ski and taper or angle rearwardly. The tapered sections 114 define an area increased channel width of tracks 46 relative to the non-tapered sections immediately rearward thereof and define a variable torsion region with the channel 46 width decreasing from front to back. The dimension a shown in FIG. 9 is the portion of channel 46 with the greatest width; the dimension B is the portion of channel 46 behind the tapered sections 114 where the width of the channels 46 is at its minimum.

The slider channel 40 of FIG. 9 is used as part of the dynamic torsional stabilizer 200 shown in FIGS. 10A, 10B and 10C. When wheels 50 are in the tapered sections 114 (as in FIG. 10A when the ski is flat and encounters little or no flex) there is some clearance between the wheels and the slider channel 40 to allow relatively free torsional twisting of the ski (in the view of FIG. 10A the wheels 50 are not in contact with the slider channel 40 at the sloped section 114, thereby allowing freedom for torsional rotation of the ski). As the ski exhibits greater de-cambering (as in FIG. 10B) the stabilizer tube 22 translates the wheels further back in the variable torsion section 114 and the tolerance between the wheels 50 and the channels 46 decreases. Stated another way, in this position there is less "play" between the wheels and the slider channel and this decreases the degree of axial rotation that the ski may exhibit. As de-cambering continues the tip of the ski has been moved far enough upwardly (as in FIG. 10C) that the wheels have entered the non-variable portion of the slider channel behind the tapered sections 114. As such, the ski exhibits maximal torsional rigidity and minimal torsional rotation. The dynamic torsional stabilizer 200 thus delivers a range of torsional rigidity properties as a function of the extent of flexural loading or deflection that the ski undergoes.

Figure 10D:
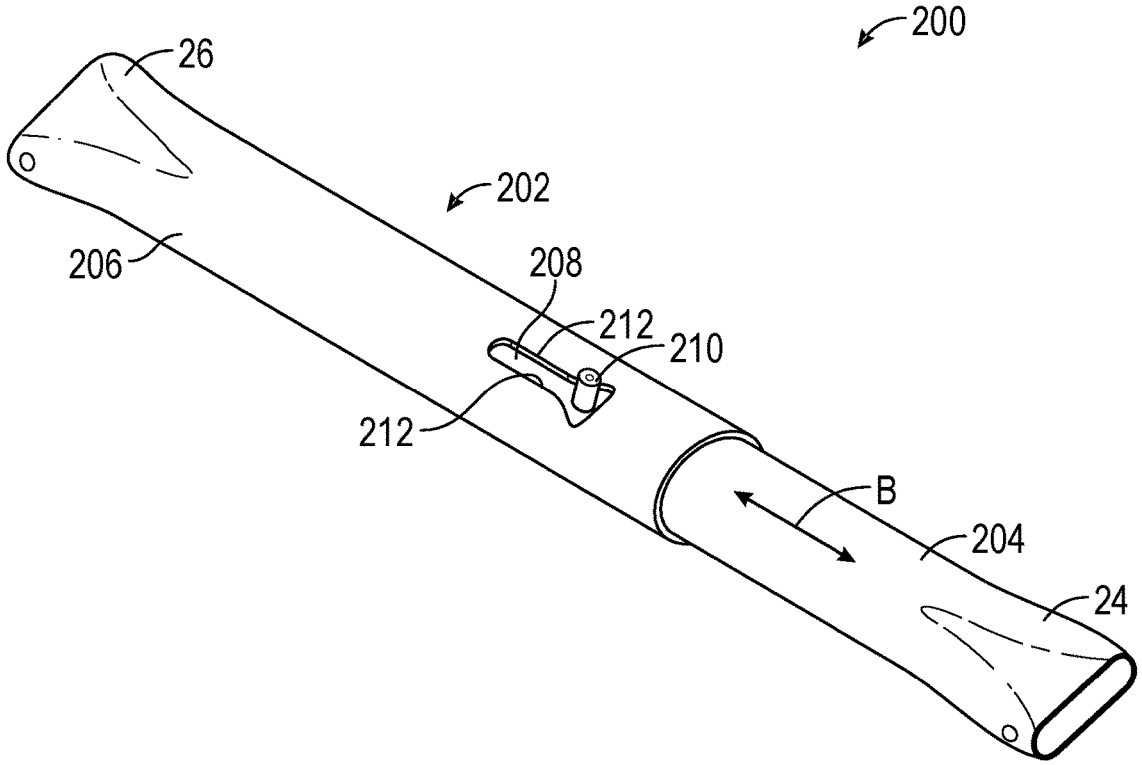
FIG. 10D is a perspective view of an embodiment of a dynamic slider tube used with a torsional stabilizer according to the invention.

There are several structural ways in which a dynamic torsional stabilizer 200 according to the invention may be made. A first preferred embodiment is shown in FIGS. 9 and 10A through 10C, and a second preferred embodiment is shown in FIG. 10D. In the embodiment of FIG. 10D, only the stabilizer tube 202 of the dynamic torsional stabilizer 200 is illustrated. In the same manner as detailed above, the forward end 24 of stabilizer tube 202 and the rearward end 26 are fixed to near the tip 14 of ski 10, and just forward of the binding toe piece, respectively, with a hinge axis extending transverse to the longitudinal axis of the ski. The stabilizer tube 202 is split into a forward inner tube 204 that is slidably received in a rearward outer tube 206—as the ski flexes and deflexed the forward inner tube 204 translates back and forth along the arrow A of FIG. 10D. A V-shaped channel 208 is formed in the upper side of outer tube 206 and, while not shown in FIG. 10D, an identical V-shaped channel is formed in the lower side of the outer tube 206 (180 degrees opposite the V-shaped channel shown in the drawing). As may be seen from the drawing, the widest part of the V-shaped channel is oriented toward the tip forward end 24 and the sidewalls 212 of the channel curve inwardly moving toward the rearward end 26 to a section 214 of the V-shaped channel in which the sidewalls 212 are parallel to one another. A pin 210 is fixed to and extends through inner tube 204 such that the opposite ends of the pin extend through both of the two V-shaped channels 208. When the ski is not flexed, the pin 210 resides in the widest portion of the V-shaped channel, which is oriented toward the tip of the ski. In this position, the ski is able to demonstrate angular deflection as torque is applied to the ski because as the ski is torsionally twisted, the pin 210 is able to move laterally back and forth in the wide part of the V-shaped channel 208. However, as the ski flexes the inner tube 204 slides rearwardly within the outer tube 206 and the pin 210 concomitantly moves rearwardly in V-shaped channel 208 into the narrow portion 214 of the V-shaped channel where the sidewalls 212 are parallel and clearance between the pin 210 and the sidewalls 212 of the V-shaped channel is at a minimum. When the ski is thus flexed so that pin 210 is in the narrow portion 214 of the V-shaped channel, the pin can no longer move laterally because the pin's movement along the X axis is blocked by the contact between the pin and the channel sidewalls 212. At this point the ski's torsional rotation is near zero.

Yet another embodiment of a dynamic torsional stabilizer 200 is shown in FIGS. 11A through 11D. In this embodiment the same dynamic torsional stabilizing functionality described above is accomplished with a stabilizer tube 202 that is defined by two tubes that have one end pivotally hinged to the ski and their interconnecting ends attached to one another with "clocked" or "timed" cam surfaces. More specifically, the stabilizer tube 202 is defined by a forward tube 220 and a rearward tube 222. The forward end 224 of forward tube 220 is pivotally hinged to ski 10 near the tip 14 of the ski, as detailed above, and a hinge pivot axis 28. The rearward end 226 of rearward tube 222 is pivotally hinged to ski 10 forward of the binding toe piece at a rear hinge axis 82.

The rearward end 228 of forward tube 220 defines opposed arms 230 that define a space 232 therebetween and the forward end 234 of rearward tube 222 is received in the space 232 in the assembled structure. When the forward and rearward tubes are assembled, an oversize bore 236 through tube 222 aligns with bores 238 in arms 230 and a pin 240 (see below, for instance, FIG. 11A) is inserted in the aligned bores. As detailed below, the joint where tubes 222 and 224 are connected with the pin 240 provides variable clearance between the structures as a function of the relative angular orientation between the two tubes.

Figure 11A:
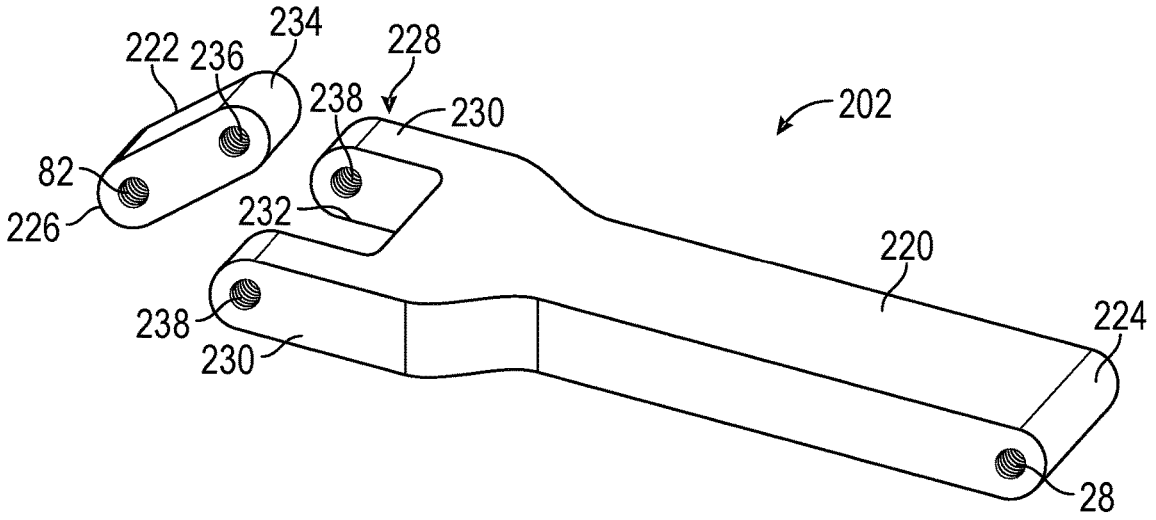
FIG. 11A is a perspective and exploded view of a second embodiment of a dynamic torsional stabilizer according to the present invention.
Figure 11B:
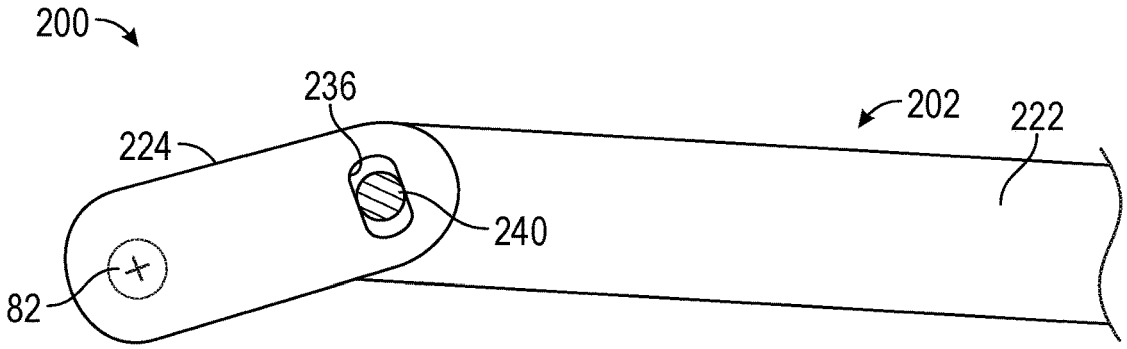
FIG. 11B is a diagrammatic side elevation view of the dynamic torsional stabilizer shown in FIG. 11A with the components in the relative positions that would be found when a ski is in a non-flexed position.

Reference is now made to the series of figures of 11B through 11C in which the two tubes 222 and 224 are assembled—in these figures only one of the arms 230 is shown in a schematic form to illustrate the cam mechanisms. In FIG. 11B the tubes 222 and 224 are shown in a position that is expected when the ski 10 to which the tubes are attached is in position with no or minimal flexural deflection. Here, there is a maximum amount of clearance between pin 240 and the oversized bore 236; the graph of FIG. 21B illustrates the angular deflection versus torque that is expected for the ski in the position of FIG. 11B.

Figure 11C:
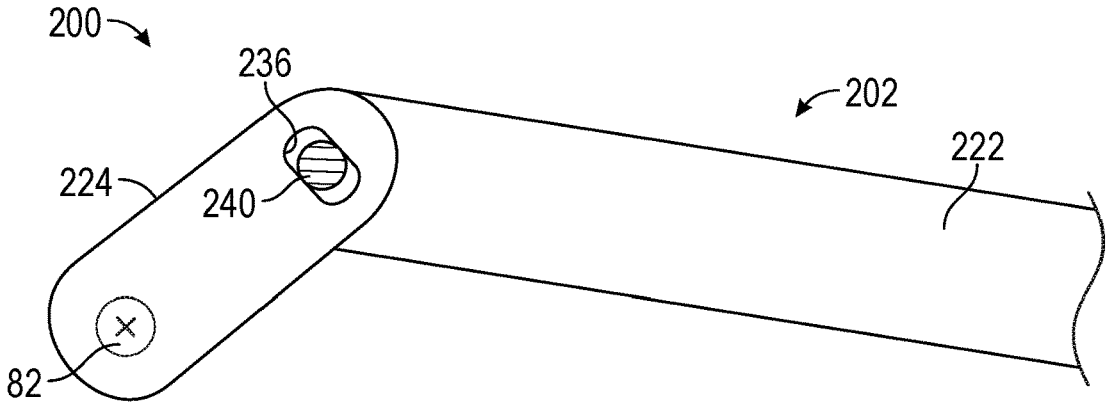
FIG. 11C is a diagrammatic side elevation view of the dynamic torsional stabilizer shown in FIG. 11A with the components in the relative positions that would be found when a ski is in a moderately-flexed position.
Figure 11D:
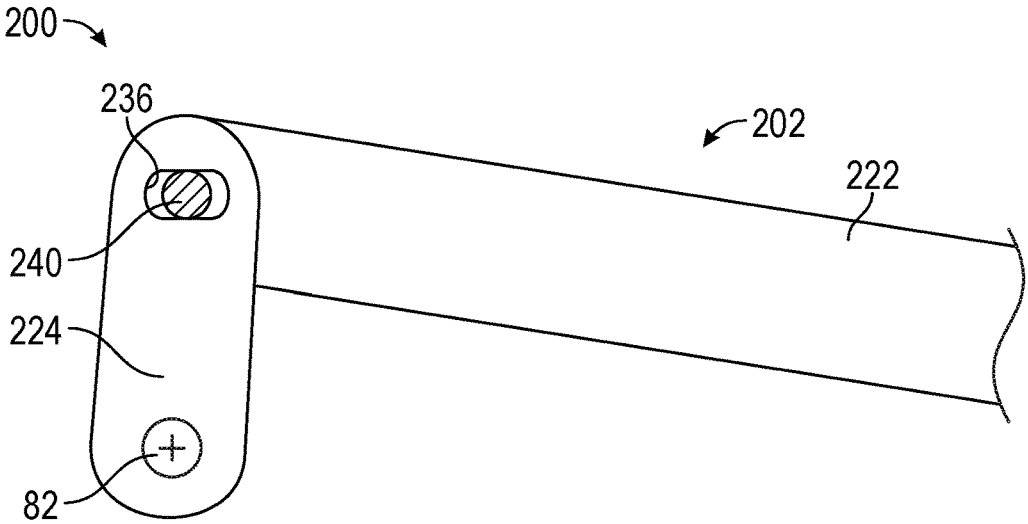
FIG. 11D is a diagrammatic side elevation view of the dynamic torsional stabilizer shown in FIG. 11A with the components in the relative positions that would be found when a ski is in a significantly-flexed position.

In FIG. 11C the ski has been moderately flexed, de-cambered, as in a moderately executed carving turn. As may be seen, as the ski flexes and with the forward and rearward ends of the tubes 222 and 224, respectively, pivoting at their hinge axes 28 and 82, the tubes 222 and 224 rotate relative to one another about pin 240. As this rotation occurs, the clearance between pin 240 and oversize bore 236 decreases, as shown, and the torsional rotation of the ski is decreased. The orientation of the dynamic torsional stabilizer 200 shown in FIG. 11C and the amount of torsional rotation of the ski corresponds to the graph of FIG. 21C. Finally, when ski 10 that includes a dynamic stabilizer 200 as shown in FIG. 11A has been maximally de-cambered as represented in FIG. 11D, the tubes 222 and 224 have rotated relative to one another about pin 240 to a maximal extend and the clearance between pin 240 and oversize bore 236 is at a minimum. As a result, torsional twisting of the ski is near zero as shown in the graph of FIG. 21D.

It will be appreciated that the various embodiments of a torsional stabilizer 20 and dynamic torsional stabilizer 200 described above are especially desirable for skiers who want to maximize the ability of the ski to execute perfectly carved turns with no "washout" caused by torsional rotation of the ski during the turn. These types of carved turns are especially fun on hard pack snow or groomers. But because snow conditions are notoriously variable, there may be some conditions where a skier wants their skis to exhibit torsional rotation during turns. For instance, skiing in deep powder can be enhanced with skis that are free to twist torsionally as torque is applied to the skis during turns. Accordingly, the present invention further comprises a lock mechanism that allows a skier to selectively engage and disengage the torsional stabilizer according to the invention that is mounted to the skis. The lock mechanism 250 according to the invention is shown in detail in FIGS. 12 through 20 and reference is now made to those drawing figures.

Figure 19:
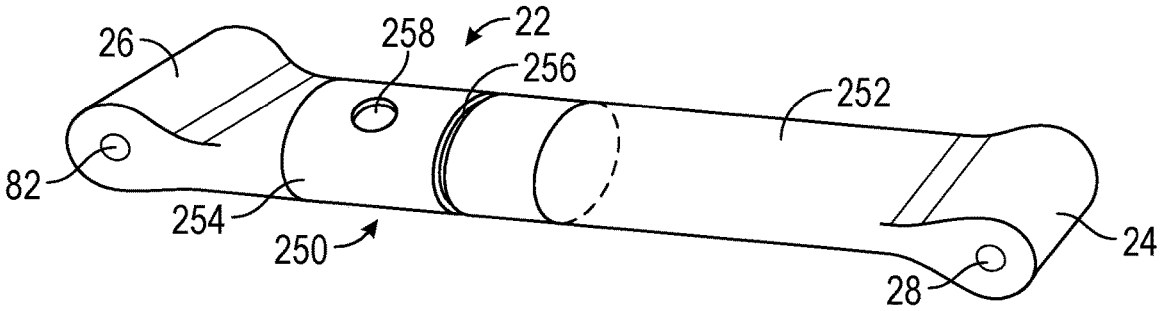

FIG. 19 illustrates a stabilizer tube 22 according to the invention and as described above, but into which the on-off lock mechanism 250 has been installed. In the embodiment shown in this figure the stabilizer tube 22 is cylindrical in cross section and the tube is split into two pieces, a forward piece 252 and a rearward piece 254 at a cut 256. A bore 258, the purpose of which is explained below, is formed in rearward piece 254 near cut 256. As also detailed below, the lock mechanism 250 is inserted into the interior of tube 22 with its component ends bonded or otherwise fixed relative to the tube so that the ends of the lock mechanism are fixed relative to the tube.

Figure 12:
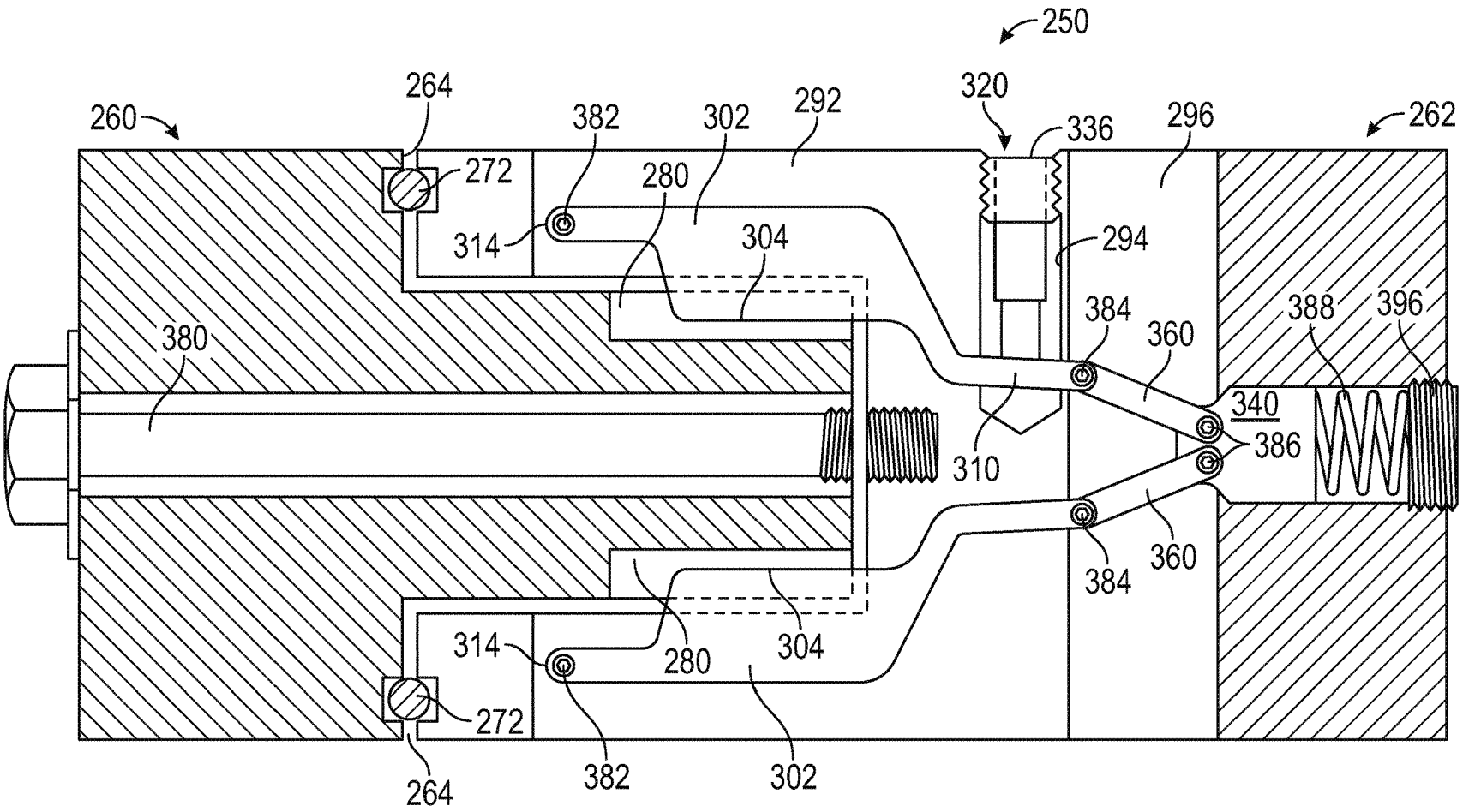
Figure 13A:
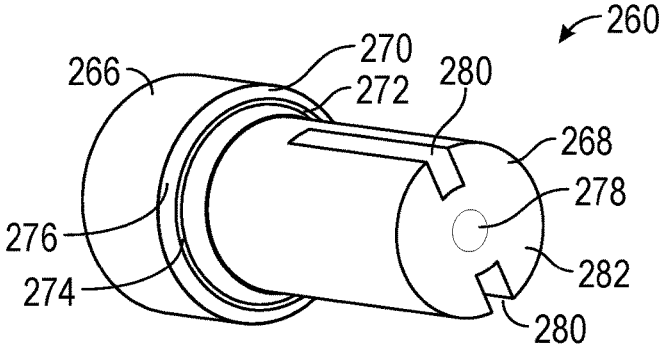
FIG. 13A is a perspective view of the twisting sleeve used in the on-off mechanism.
Figure 13B:
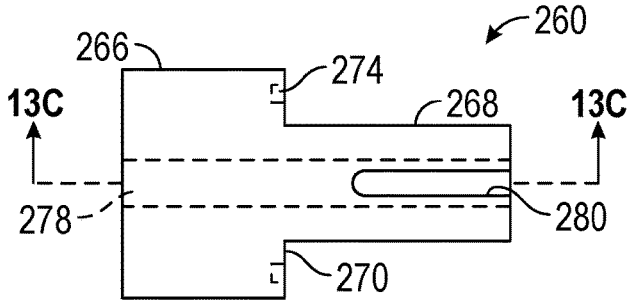
FIG. 13B is a top plan view of the twisting sleeve shown in FIG. 13A.
Figure 13C:
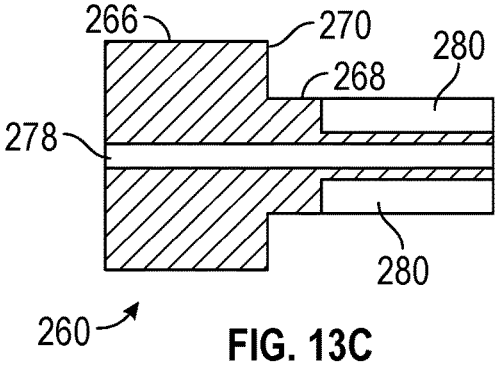
FIG. 13C is a cross sectional view taken along the line 13C-13C of FIG. 13B.
Figure 13D:
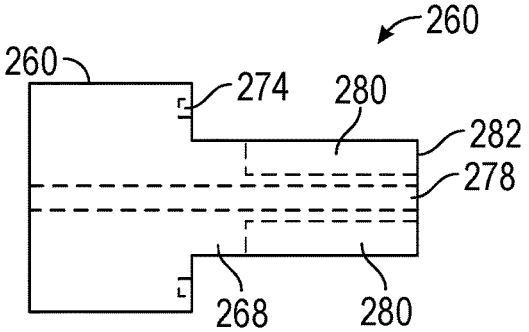
FIG. 13D is a side elevation view of the twisting sleeve of FIG. 13A.
Figure 13E:
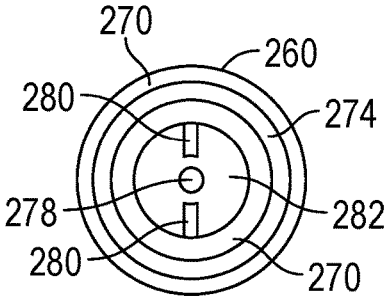
FIG. 13E is an end view of the twisting sleeve of FIG. 13A.
Figure 14A:
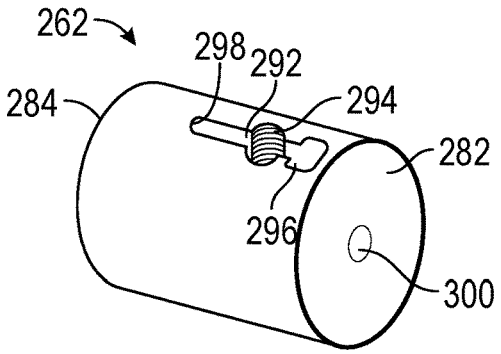
FIG. 14A is a perspective view of an actuator sleeve used in the on-off mechanism.
Figure 14B:
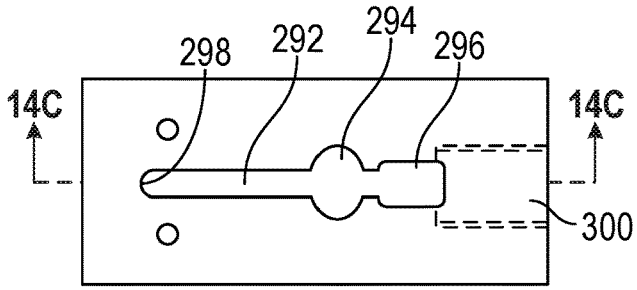
FIG. 14B is a top plan view of the actuator sleeve shown in FIG. 14A.
Figure 14C:
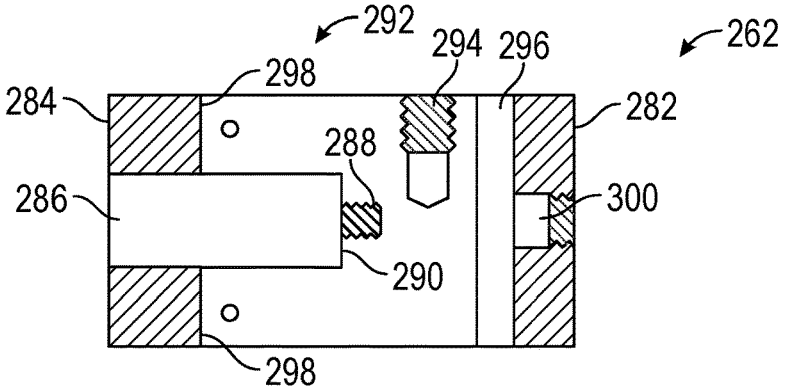
FIG. 14C is a cross sectional view taken along the line 14C-14C of FIG. 14B.
Figure 14D:
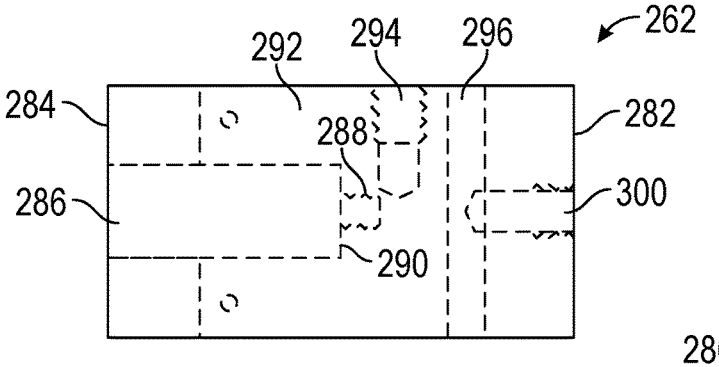
FIG. 14D is a side elevation view of the actuator sleeve shown in FIG. 14A.
Figure 14E:
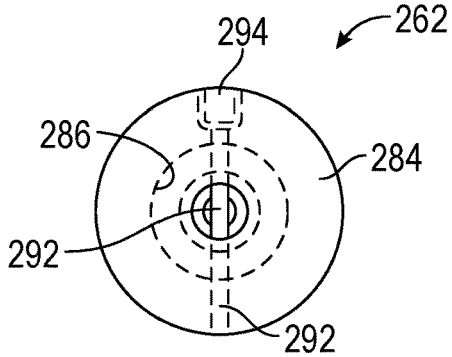
FIG. 14E is an end view of the actuator sleeve of FIG. 14A.
Figure 15A:
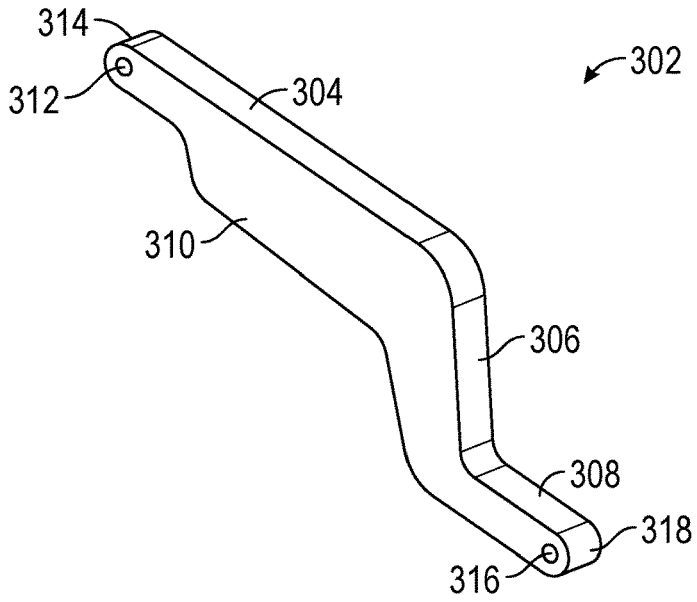
FIG. 15A is a perspective view of a lock blade deflector used in the on-off mechanism.
Figure 15B:
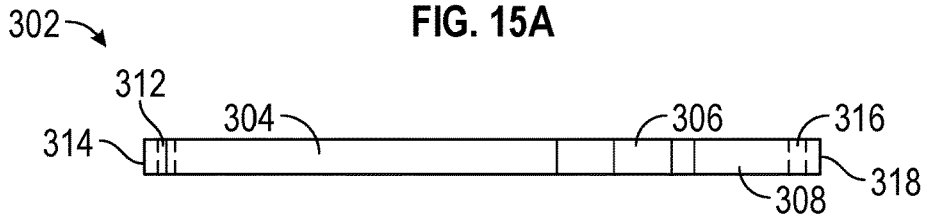
FIG. 15B is a top plan view of the lock blade deflector of FIG. 15A.
Figure 15C:
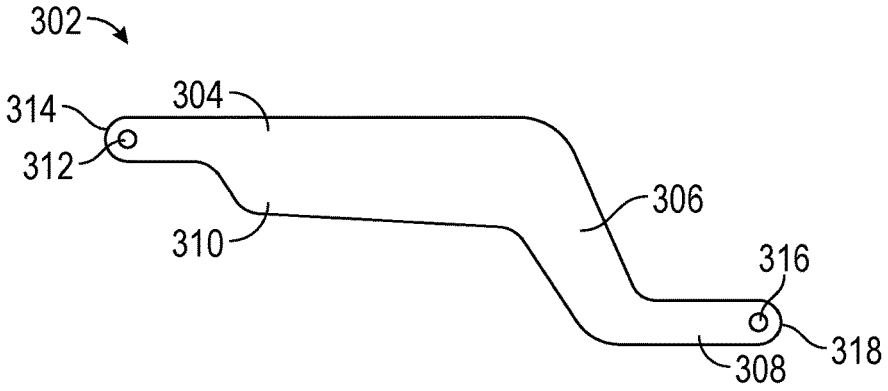
FIG. 15C is a side elevation view of the lock blade deflector shown in FIG. 15A.
Figure 15D:
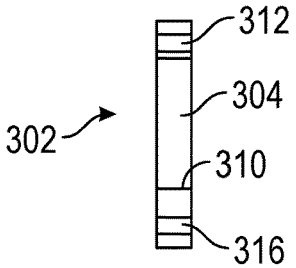
FIG. 15D is an end view of the lock blade deflector of FIG. 15A.

Lock mechanism 250 is shown in isolation in FIG. 12. In general terms, lock mechanism 250 is defined by a twisting sleeve 260 and an actuator sleeve 262 that are interconnected as detailed below and which may be rotated relative to one another about joint 264. When the lock 250 is assembled into the tube 22 shown in FIG. 19, twisting sleeve 260 is inserted into the interior of rearward piece 254 and actuator sleeve 262 is inserted into the forward piece 252 and both the twisting and actuator sleeves are fixed relative to the tube (by press fit and/or adhesives and the like) to prevent relative rotation between the sleeves and the tube pieces. Joint 264 between sleeves 260 and 262 aligns with cut 256 in the tube 22.

Twisting sleeve 260 is shown in isolation and in detail in FIGS. 13A through 13F. The cylindrical base 266 is the portion of sleeve 260 that is inserted into tube 22 and thus defines a diameter that is nearly the same as the interior diameter of tube 22 so that that the sleeve may be press fit and bonded in the tube. A cylindrical forward and axially aligned extension 268 is defined at a stepped shoulder 270 and an O-ring 272—is installed in an O-ring groove 274 in the face 276 of stepped shoulder 270. An axial center bore 278 extends through sleeve 260 and two grooves 280 are formed at 180 degrees from one another on cylindrical forward extension 268. Both grooves 280 are open at the forward end 282 of the forward extension 268.

Actuator sleeve 262 is shown in isolation and in detail in FIGS. 14A through 14E. As noted above, actuator sleeve 262 pairs with twisting sleeve 260 as the primary components of lock mechanism 250 and actuator sleeve 262 is inserted into the interior of forward piece 252 and is fixed relative to the tube (by press fit and/or adhesives and the like) to prevent relative rotation between the sleeve and the tube. Generally, actuator sleeve 262 is a cylindrical member that has an outer diameter that is of a size that the member slips tightly into the interior of the stabilizer tube 22 such that a forward end 282 of the sleeve 262 is oriented toward the forward end 24 and the opposite, rearward end 284 of the sleeve is coincident with the joint 264. A cylindrical bore 286 is axially formed in rearward end 284 and has a diameter such that cylindrical extension 268 may be inserted into the bore 286 and a depth such that when the cylindrical extension 268 of twisting sleeve 260 is inserted into cylindrical bore 286 the rearward end 284 abuts shoulder 270, thereby compressing O-ring 272 and such that the twisting sleeve and the actuator sleeve may axially rotate relative to one another (when the lock mechanism is unlocked, as detailed below). An axially aligned threaded bore 288 is formed in the terminal end 290 of cylindrical bore 286.

An open slot 292 is formed in actuator sleeve 262 as illustrated and extends completely through the sleeve along the longitudinal axis of the sleeve and a threaded blind bore 294 extends partially into the sleeve 262 about ⅔ of the distance along slot 292. Adjacent blind bore 294 toward forward end 282 of the sleeve the slot is slightly widened at widened portion 296. The opposite end 298 of slot 292—that is, the end of the slot extending toward rearward end 284 of sleeve 262 overlaps with cylindrical bore 286 when sleeves 260 and 262 are assembled. A bore 300 is axially formed in forward end 282 of sleeve 262 and extends into the widened portion 296 of open slot 292. Bore 300 has a threaded portion near the forward end 282 and a non-threaded end toward the interior of the sleeve.

The structures that define the locking portions of lock mechanism 250 will now be described with reference to FIGS. 15 through 18. The locking portions generally define a linkage system comprising a pair of lock blades 302, an actuator 320, a slider 340 and a pair of link arms 360. Each of these components will be described individually before the assembled lock will be detailed.

With reference to FIGS. 15A through 15D, two identical lock blades 302 are used in lock mechanism 250 and they define generally L-shaped members with a first leg 304, transverse leg 306 and a second leg 308. A locking edge 310 is defined by one side of leg portion 306. A bore 312 is formed near the distal end 314 of first leg 304 and a bore 316 is formed near the proximate end 318 of second leg 308.

Figure 16A:
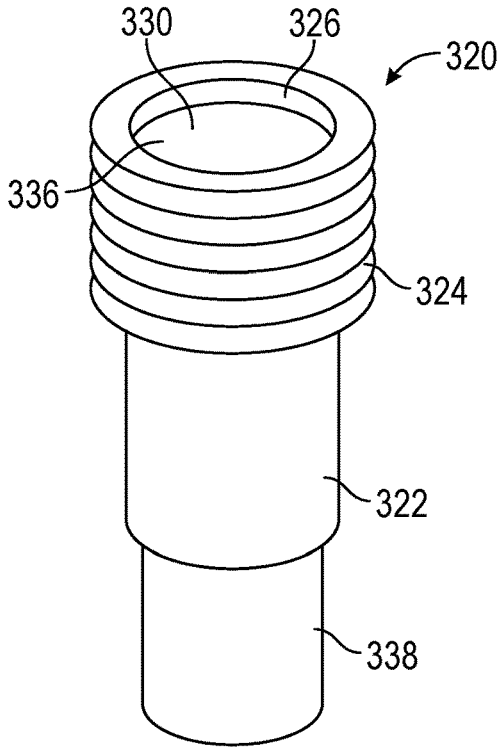
FIG. 16A is a perspective view of an actuator used in the on-off mechanism.
Figure 16B:
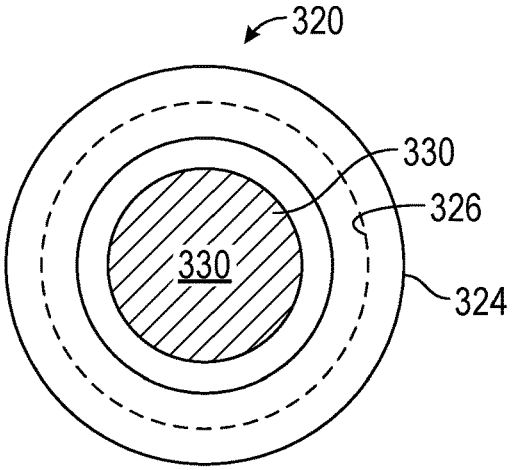
FIG. 16B is an end view of the actuator of FIG. 16A.
Figure 16C:
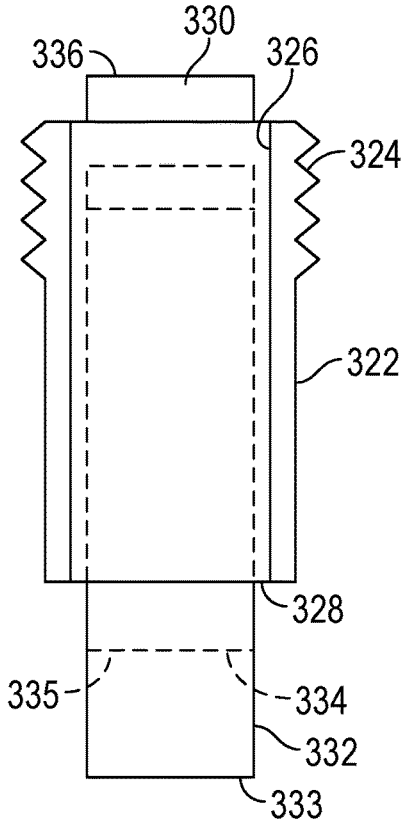
FIG. 16C is a side elevation view of the actuator of FIG. 16A.
Figure 17A:
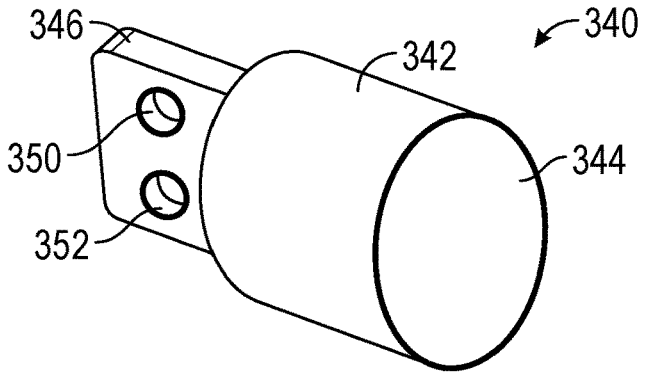
FIG. 17A is a perspective view of a slider used in the on-off mechanism.
Figure 17B:
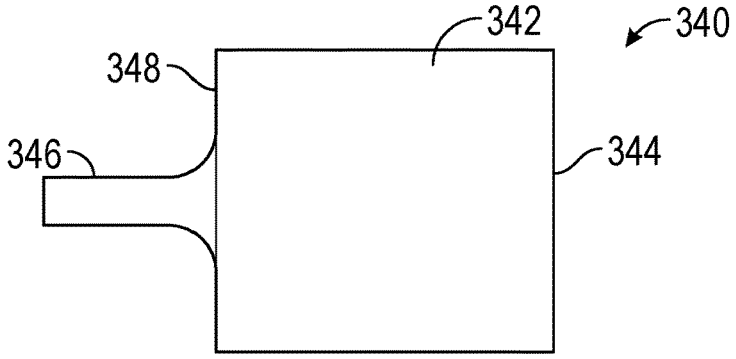
FIG. 17B is a top plan view of the slider of FIG. 17A.
Figure 17C:
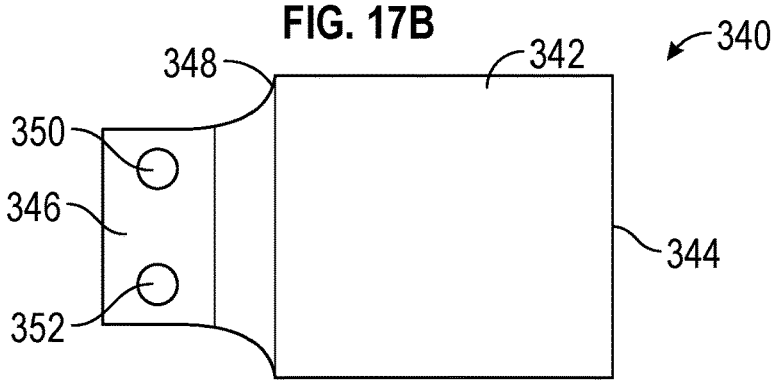
FIG. 17C is a side elevation view of the slider of FIG. 17A.
Figure 17D:
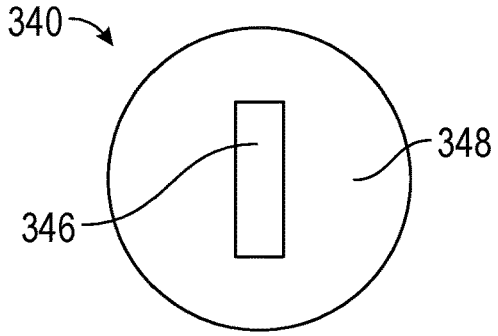
FIG. 17D is an end view of the slider of FIG. 17A.
Figure 18A:
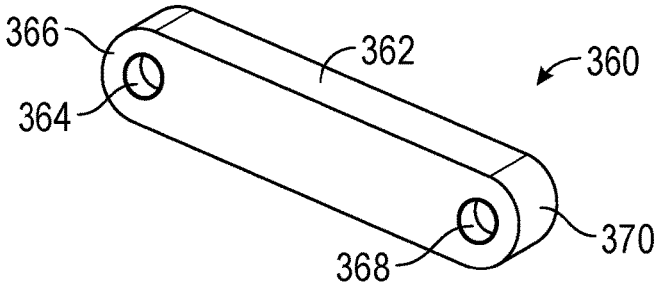
FIG. 18A is a link arm used in the on-off mechanism.
Figure 18B:
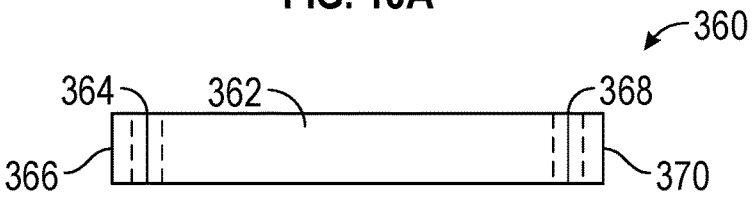
FIG. 18B is a top plan view of the link arm of FIG. 18A.
Figure 18C:
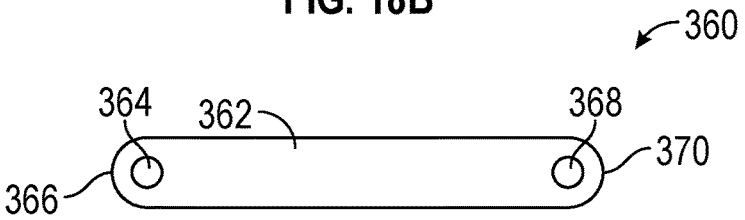
FIG. 18C is a side elevation view of the link arm of FIG. 18A.
Figure 18D:
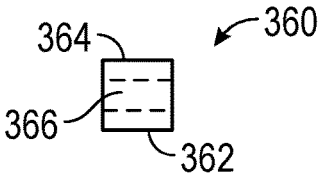
FIG. 18D is an end view of the link arm of FIG. 18A.

Turning to FIGS. 16A through 16C, actuator 320 defines the skier-interface with lock mechanism 250 and is used to selectively engage the lock mechanism (i.e., to lock it when the skier desires torsional rigidity for her skis) or to disengage the lock mechanism, that is, to unlock it when the skier wants the torsional flex that the ski normally experiences. Actuator 320 is a spring-loaded on-off button that is mechanically akin to the on-off buttons that are typically used in, for example, ballpoint pens. A cylindrical body 322 has a threaded outer wall 324 at an open upper end 326 and an opposite open lower end 328. The spring-loaded on-off button 330 is a cylindrical member 338 that is received in the open interior of cylindrical body 322 and is movable between an "on" position illustrated in FIG. 16C with solid lines at reference number 332 and a retracted or "off" position 324 shown with phantom lines in FIG. 16C. Because button 330 is spring-loaded, when the exposed upper end 336 is depressed the opposite lower end 333 of cylinder 338 is driven downwardly into an extended position; the button latches in this position. When the exposed end 336 is again depressed, the button de-latches and the cylinder 338 and thus the lower end 333 thereof is retracted into unlocked position (phantom lines in FIG. 16C).

Slider 340 is shown in FIGS. 17A through 17D and is defined by a cylindrical plug 342 with a flattened first end 344 and a blade 346 extending from the opposite end 348. An upper bore 350 and a lower bore 352 are formed in blade 346.

A link arm 360 is illustrated in FIGS. 18A through 18D and is defined by an elongate arm 362 having a bore 364 adjacent distal end 366 and a bore 368 adjacent proximate end 370.

The assembly and operation of the components of lock mechanism 250 will now be described with reference to the cross sectional drawings of FIGS. 20 and 12B, beginning with FIG. 20. The cylindrical extension 268 of twisting sleeve 260 is inserted into cylindrical bore 286 of actuator sleeve 262 and is secured in place with a bolt 380 that extends through bore 278 in sleeve 260 and threads into threaded bore 288 of sleeve 262. Bolt 380 is tightened sufficiently to compress O-ring 272 between the facing shoulders 270 and 284 of the sleeves 260 and 262, respectively, yet allow the sleeves to axially rotate relative to one another. Lock blades 302 are retained in slot 292 with the distal ends 314 of the blades pivotally attached to sleeve 262 with pins 382 extending through bores 312—the opposite ends of the pins 382 are fixed to the opposed sidewalls of the slot 202. The sleeves 260 and 262 are nominally oriented relative to one another so that lock blades 302 are oriented so that they are aligned with the grooves 280.

Link arms 360 are pivotally attached to the proximate ends 318 of lock blades 302 with pins 384 that extend through the aligned bores 316 of the lock blades and 364 at the distal ends of the link arms. The proximate ends of the link arms 360 are pivotally attached to the blade 346 of slider 340, and more specifically with pins that extend through bores 368 in the link arms and into bores 350 and 352 in the blade 346.

Figure 20:
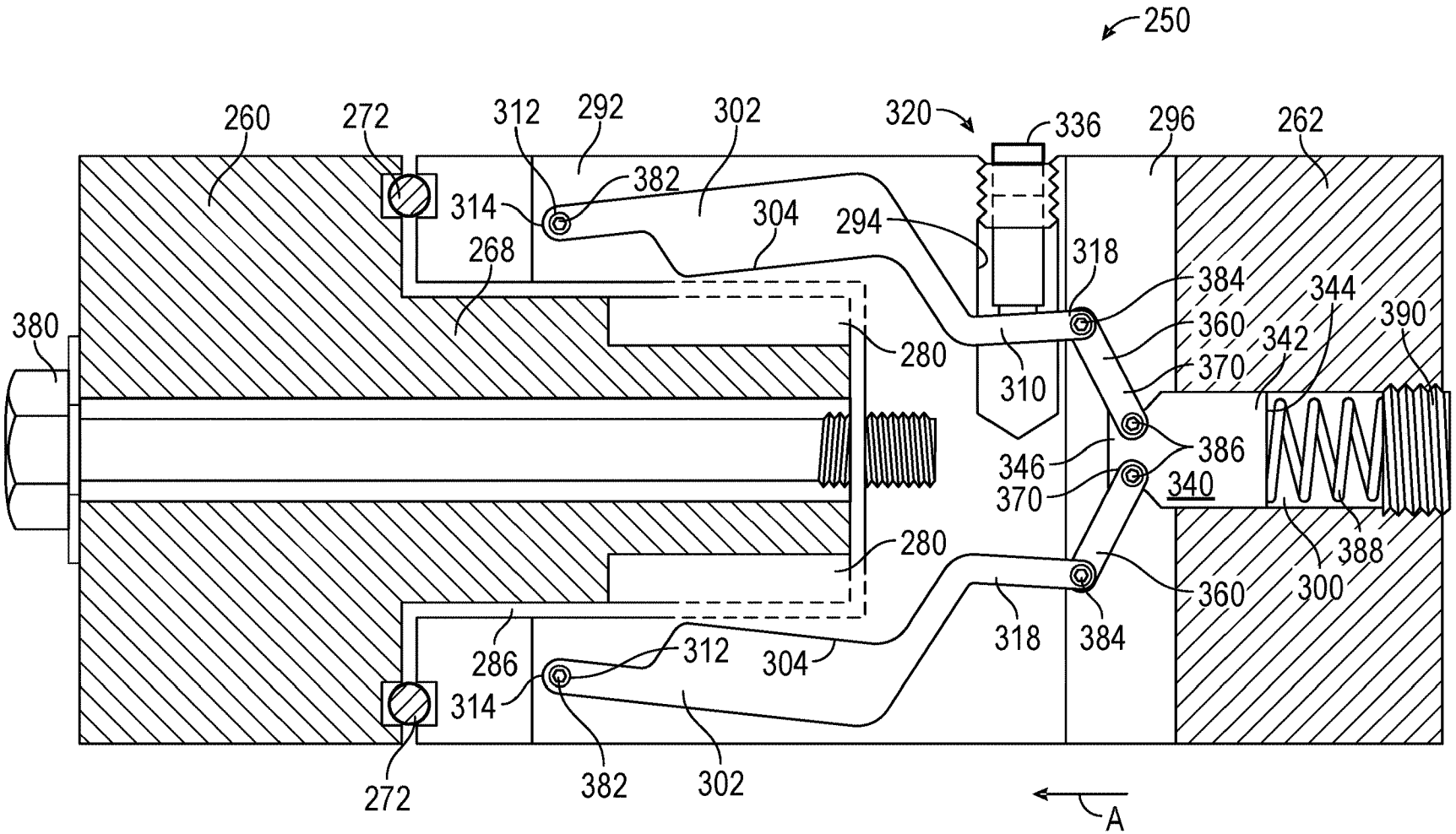

As shown in FIG. 20, the plug 342 of slider 340 is received in the non-threaded portion of bore 300. A spring 388 is received in the non-threaded portion of bore 300 and bears on end 344 of slider 340. A plug 390 is threaded into the threaded portion of bore 300 to compress the spring 388 against slider 340. As illustrated in FIGS. 12 and 20, the pivotal interconnections between lock blades 302 and link arms 360, and between link arms 360 and blade 346 of slider 340, are positioned in widened portion 296 of slot 292. Actuator 320 is threaded into threaded bore 294 of actuator sleeve 262 so that the upper end of the cylinder 338 is exposed. When actuator 320 is threaded into sleeve 262 as described, the lower end 333 of the cylinder 338 bears against the second leg 310 of one lock blade 302—in the drawings of FIGS. 12 and 20, against the uppermost lock blade.

Turning now to FIG. 19, the lock mechanism 250 is shown installed in tube 22 and when installed, actuator 320 is exposed through bore 258 in the tube. As described above, both the twisting sleeve 260 and actuator sleeve 262 are fixed relative to the front portion 252 and rear portion 254, respectively, of tube 22 with the joint 264 aligned with the cut 256 between the two parts of the cut tube 22.

The dis-engaged position of the lock mechanism 250 is shown in FIG. 20. In this position, the cylinder 338 is in the retracted position and the lower end 333 is bearing against second leg 310 of lock blade 302. Spring 388 is bearing against end 344 of slider 340, urging the slider in the direction of arrow A in FIG. 20. Under the spring pressure the linkages defined by link arms 360 and lock blades 302 causes the lock blades to pivot at pins 382, moving the lock edges 304 out of grooves 280 of twisting sleeve 260. In this position the lower end 333 of the cylinder 338 remains in contact with second leg 310 of the lock blade 302, but there is clearance between the lock edges 304 and the grooves 280. As such, the twisting sleeve 260 is free to rotate relative to the actuating sleeve 262. It will thus be appreciated that when the lock mechanism 250 is in the unlocked position of FIG. 20 a ski 10 is free to twist torsionally about the Y (longitudinal) axis of the ski.

When a skier desires to eliminate torsional rotation of their skis so that the skier can make hard carving turns, the locking mechanism 250 is locked. With the ski in a flat position and the locking mechanism unlocked, the lock blades 302 of the locking mechanism 250 are oriented so that they are aligned with grooves 280. The mechanism is switched to the locked or engaged position by depressing the actuator 320, for instance, with the tip of the skier's ski pole pushing down on exposed end 336 of cylinder 338. This moves the cylinder downwardly with the lower end 333 bearing against second leg 310 of the upper lock blade 302. The pressure of the ski pole applied to cylinder 338 causes force to be transmitted through link arms 360 and applied to slider 340 against the counter-pressure of spring 388. As cylinder 388 is forced downwardly by the skier the lock blades pivot at pins 382 and the locking edges 304 enter the grooves 280 as shown in FIG. 12. The spring-loaded actuator engages—locks in the locked position shown in FIG. 12 with the locking edges in the grooves 280. This prevents axial rotation of sleeve 260 relative to sleeve 262 and thus prevents axial rotation of the ski.

While the present invention has been described in terms of preferred and illustrated embodiments, it will be appreciated by those of ordinary skill that the spirit and scope of the invention is not limited to those embodiments, but extend to the various modifications and equivalents as defined in the appended claims. For example, those of ordinary skill in the art will recognize that the inventions described herein and shown in the drawings are applicable to snow boards, especially those types of snow boards that are designed for and suited to carved turns. Accordingly, the term "ski" as used herein and in the claims is used generically; it should be construed to mean not only alpine skis but also snow boards.

The invention claimed is:

1. A stabilizer for a ski that defines a longitudinal axis between a tip and a tail, an upper surface and a binding toe piece attached to the upper surface between the tip and the tail, comprising:

an elongate member having a first end and a second end, the first end pivotally mounted to the upper surface posteriorly of the tip;

a second end attachment member mounted to the upper surface anteriorly of the binding toe piece;

wherein the second end of the elongate member defines an interface for interconnecting the elongate member with the second end attachment member such that when the ski is de-cambered to a first position the second end of the elongate member engages the second end attachment member so that the elongate member impedes torsional rotation of the ski about the longitudinal axis by a first amount, and when the ski is de-cambered to a second position that defines greater de-camber than the first position the second end of the elongate member is engaged with the second end attachment member so that elongate member impedes torsional rotation of the ski about the longitudinal axis by a second amount that is different than the first amount.

2. The stabilizer according to claim 1 in which the first end of the elongate member is pivotal about a pivot axis that is transverse to the longitudinal axis and wherein when the ski is in the second position the elongate member impedes torsional rotation of the ski about the longitudinal axis by a greater amount than when the ski is in a first position.

3. The stabilizer according to claim 2 wherein the second end of the elongate member is longitudinally slidable relative to the second end attachment member as the ski flexes along the longitudinal axis.

4. The stabilizer according to claim 3 in which the second end attachment member comprises opposed first and second tracks and the interface on the second end of the elongate member is defined by a pair of wheels axially mounted to the second end of the elongate member along an axis transverse to the longitudinal axis, wherein one wheel of the pair is movably received in the first track and the other wheel of the pair is movably received in the second track.

5. The stabilizer according to claim 4 in which the opposed first and second tracks have tapered inlet sections that define track widths that are greater than the diameter of the wheels.

6. The stabilizer according to claim 5 wherein when the ski flexes along the longitudinal axis the elongate member pivots about the pivot axis of the attachment of the first end of the elongate member and the wheels translate longitudinally in the first and second tracks relative to the second end attachment member.

7. The stabilizer according to claim 6 in which the portion of the ski between the binding toe piece and the tip is prevented from torsional rotation when the ski flexes along the longitudinal axis.

8. A stabilizer for a ski that defines a longitudinal axis between a tip and a tail, an upper surface and a binding toe piece attached to the upper surface between the tip and the tail, comprising:

an elongate stabilizer member having a forward end pivotally mounted to the upper surface of the ski adjacent to the tip for pivotal rotation about an axis transverse to the longitudinal axis;

an attachment member mounted to the upper surface of the ski anteriorly of the binding toe piece;

wherein the second end of the stabilizer member is interconnected to the attachment member such that the stabilizer member translates along the longitudinal axis relative to the attachment member as the ski is de-cambered between first and second positions and the elongate stabilizer member impedes torsional rotation of the ski about the longitudinal axis when the ski is in the second position by a greater amount than when the ski is in the first position.

9. The stabilizer according to claim 8 in which the second end of the stabilizer member is longitudinally slidable in the attachment member and wherein the amount of torsional rotation of the ski about the longitudinal axis decreases with increased de-cambering of the ski along the longitudinal axis.

10. An apparatus for stabilizing a ski that defines a longitudinal axis between a tip and a tail, an upper surface and a binding toe piece attached to the upper surface between the tip and the tail, comprising:

a stabilizer having a first end and a second end, the first end pivotally mounted to the upper surface of the ski posteriorly of the tip;

a receiver mounted to the upper surface or the ski anteriorly of the binding toe piece;

wherein when the ski is in a first flexed position in which the ski is de-cambered by a first amount the second end of the stabilizer interacts with the receiver but does not impede the torsional rotation of the ski about the longitudinal axis, and wherein when the ski is in a second flexed position in which the ski is de-cambered by a second amount that is greater than the first amount the second end of the stabilizer interacts with the receiver to thereby impede torsional rotation of the ski about the longitudinal axis.

11. The apparatus according to claim 10 in which the ski is flat in the first position.

12. The apparatus according to claim 11 wherein the second end of the stabilizer is longitudinally slidable relative to the receiver as the ski moves from the first flexed position to the second flexed position.

13. The apparatus according to claim 12 in which the second end of the stabilizer comprises opposed first and second tracks and the second end of the stabilizer is defined by a pair of wheels axially mounted to the second end of the stabilizer along an axis transverse to the longitudinal axis, wherein one wheel of the pair is received in the first track and the other wheel of the pair is received in the second track.

14. The apparatus according to claim 13 in which the opposed first and second tracks have tapered inlet sections that define track widths that are greater than the diameter of the wheels.

15. The apparatus according to claim 14 wherein when the ski flexes along the longitudinal axis the stabilizer pivots about the pivot axis of the first end of the stabilizer and the wheels translate longitudinally in the first and second tracks relative to the receiver.

16. The apparatus according to claim 10 wherein the amount of torsional rotation of the ski about the longitudinal axis decreases with increased flexure of the ski along the longitudinal axis.

* * * * *